US010565951B2

(12) United States Patent
Gotoh et al.

(10) Patent No.: US 10,565,951 B2
(45) Date of Patent: Feb. 18, 2020

(54) DISPLAY DEVICE

(71) Applicant: Japan Display Inc., Minato-ku (JP)

(72) Inventors: Fumitaka Gotoh, Minato-ku (JP); Isao Edatsune, Minato-ku (JP); Yutaka Ozawa, Minato-ku (JP); Tsutomu Harada, Minato-ku (JP)

(73) Assignee: Japan Display Inc., Minato-ku (JP)

( * ) Notice: Subject to any disclaimer, the term of this patent is extended or adjusted under 35 U.S.C. 154(b) by 0 days.

(21) Appl. No.: 15/161,933

(22) Filed: May 23, 2016

(65) Prior Publication Data

US 2016/0351145 A1 Dec. 1, 2016

(30) Foreign Application Priority Data

May 28, 2015 (JP) ..... 2015/109022

(51) Int. Cl.
*G09G 3/36* (2006.01)

(52) U.S. Cl.
CPC ... *G09G 3/3677* (2013.01); *G09G 2310/0286* (2013.01); *G09G 2330/12* (2013.01)

(58) Field of Classification Search
CPC ..... G09G 3/3674; G09G 2310/0286; G09G 2330/12; G09G 2310/0267
See application file for complete search history.

(56) References Cited

U.S. PATENT DOCUMENTS

2014/0118324 A1 5/2014 Chan et al.
2017/0097650 A1* 4/2017 Zhang ..... G05F 1/625

FOREIGN PATENT DOCUMENTS

CN 103123779 A 5/2013
JP 5-346587 12/1993
JP 10-111498 4/1998
JP 2013-160999 * 8/2013

OTHER PUBLICATIONS

Office Action dated Oct. 12, 2018 in corresponding Chinese Patent Application No. 201610349508.1 with English Translation.
Office Acton dated Mar. 25, 2019 in Chinese Patent Application No. 201610349508.1 (with unedited computer generated English translation).
Office Action dated Aug. 23, 2019, in Chinese Patent Application No. 201610349508.1, with English-language Machine Translation.

* cited by examiner

*Primary Examiner* — Dennis P Joseph
(74) *Attorney, Agent, or Firm* — Oblon, McClelland, Maier & Neustadt, L.L.P.

(57) ABSTRACT

According to an aspect, a display device includes: a display area provided to a substrate; a shift register including a plurality of registers coupled in series; and a control circuit that supplies clock pulses to the registers, and that supplies a start pulse to a first register of the shift register to acquire an output from a last register of the shift register, wherein the display area is provided in an area surrounded by the shift register, the control circuit, and wiring that couples the shift register to the control circuit.

12 Claims, 18 Drawing Sheets

DISPLAY DEVICE

CROSS-REFERENCE TO RELATED APPLICATIONS

This application claims priority from Japanese Application No. 2015-109022, filed on May 28, 2015, the contents of which are incorporated by reference herein in its entirety.

BACKGROUND

1. Technical Field

The present invention relates to a display device.

2. Description of the Related Art

In these years, flat panel display devices each employing a liquid crystal panel are widely used as in-vehicle display devices, such as car navigation systems. Such a flat panel display device is conceivable to be used, for example, as an in-vehicle display that assists driving of a driver by displaying an image outside an automobile taken by a camera mounted on the body of the automobile.

In general, a breakage in a display panel, such as a liquid crystal display device, can be detected by viewing or using a program for electrically detecting the breakage. However, assume, for example, that the display device becomes incapable of normally displaying an image. To determine whether breakage of the display panel or failure of a processing device for controlling the display on the display device has caused the problem, for example, both the display panel and processing device need to be checked, and thus it takes time to determine which part has failed. An in-vehicle system, in particular, is required to have means for easily and quickly identifying the failed part. Japanese Patent Application Laid-open Publication No. H05-346587 discloses a technique, in which crack detection electrodes are laid at locations other than places where display electrodes are laid on a transparent substrate forming a liquid crystal display element, and the crack detection electrodes are tested for conductivity to electrically detect the breakage of the liquid crystal display element.

The conventional technique described above needs to additionally provide the crack detection electrodes and additionally requires a circuit and control to test the crack detection electrodes for conductivity, which may increase the size of the device.

For the foregoing reasons, a display device that is capable of easily and quickly detecting the breakage of a display panel without causing an increase in the size of the device.

SUMMARY

According to an aspect, a display device includes: a display area provided to a substrate; a shift register including a plurality of registers coupled in series; and a control circuit that supplies clock pulses to the registers, and that supplies a start pulse to a first register of the shift register to acquire an output from a last register of the shift register, wherein the display area is provided in an area surrounded by the shift register, the control circuit, and wiring that couples the shift register to the control circuit.

DETAILED DESCRIPTION

Figure 1:
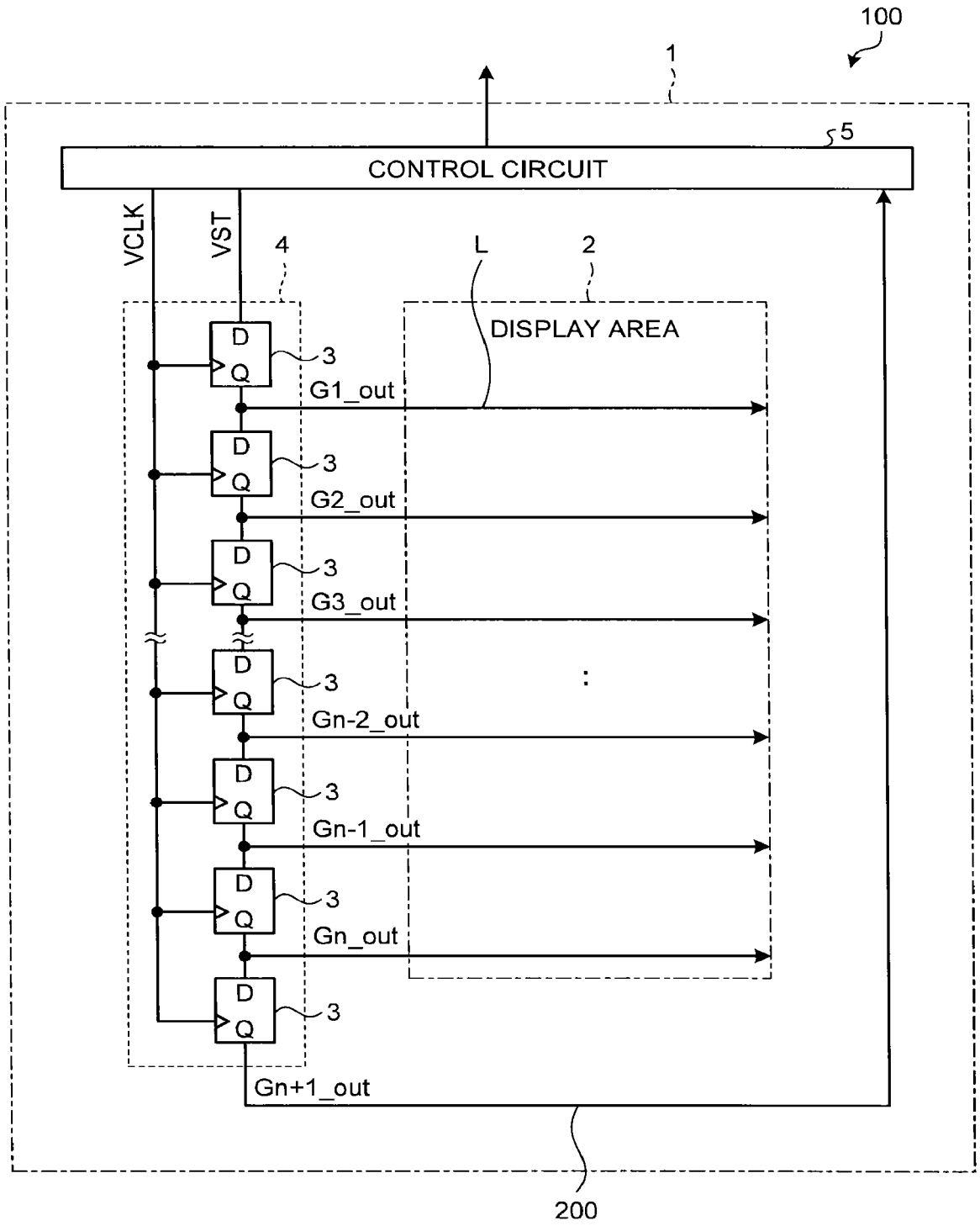
FIG. 1 is a diagram illustrating the schematic configuration of a display device according to a first embodiment.

The following describes details of preferred embodiments for carrying out the invention with reference to the drawings.

The present invention is not limited to the description of the embodiments to be given below. Components to be described below include a component or components that is/are easily conceivable by those skilled in the art or substantially the same component or components. Moreover, the components to be described below can be appropriately combined. The disclosure is merely an example, and the present invention naturally encompasses an appropriate modification maintaining the gist of the invention that is easily conceivable by those skilled in the art. To further clarify the description, a width, a thickness, a shape, and the like of each component may be schematically illustrated in the drawings as compared with an actual aspect. However, this is merely an example, and interpretation of the invention is not limited thereto. The same element as that described in the drawing that has already been discussed is denoted by the same reference numeral through the description and the drawings, and detailed description thereof will not be repeated in some cases where appropriate.

First Embodiment

FIG. 1 is a diagram illustrating the schematic configuration of a display device according to a first embodiment. As illustrated in FIG. 1, this display device 100 according to the present embodiment includes a display area 2 provided to a substrate 1, a shift register 4, and a control circuit 5. The shift register 4 includes a plurality of registers 3 coupled in series and is arranged along a side of the display area 2. The control circuit 5 supplies a clock pulse VCLK to each of the registers 3, and that supplies a start pulse VST to a register 3 at the first stage (hereinafter referred to as the first register 3) of the shift register 4 to acquire an output Gn+1_out from a register 3 at the last stage (hereinafter referred to as the last register 3) of the shift register 4.

The display area 2 is provided in an area surrounded by the shift register 4, the control circuit 5, and wiring that couples the shift register 4 to the control circuit 5. The display area 2 is provided with n pieces of wiring L (where n is a natural number), each of which is coupled at one end thereof to corresponding one of coupling portions between the registers 3. Wiring 200 transmits the output Gn+1_out from the last register 3 of the shift register 4 and is laid so as to separate the display area 2 from outer circumferential ends of the substrate 1.

Each of the registers 3 included in the shift register 4 may be, for example, a flip-flop (FF) circuit.

Based on the output Gn+1_out from the last register 3 of the shift register 4, the control circuit 5 determines whether the substrate 1 has been broken. If a breakage of the substrate 1 has been detected, the control circuit 5 outputs an alert to a higher-level system control unit.

Figure 2:
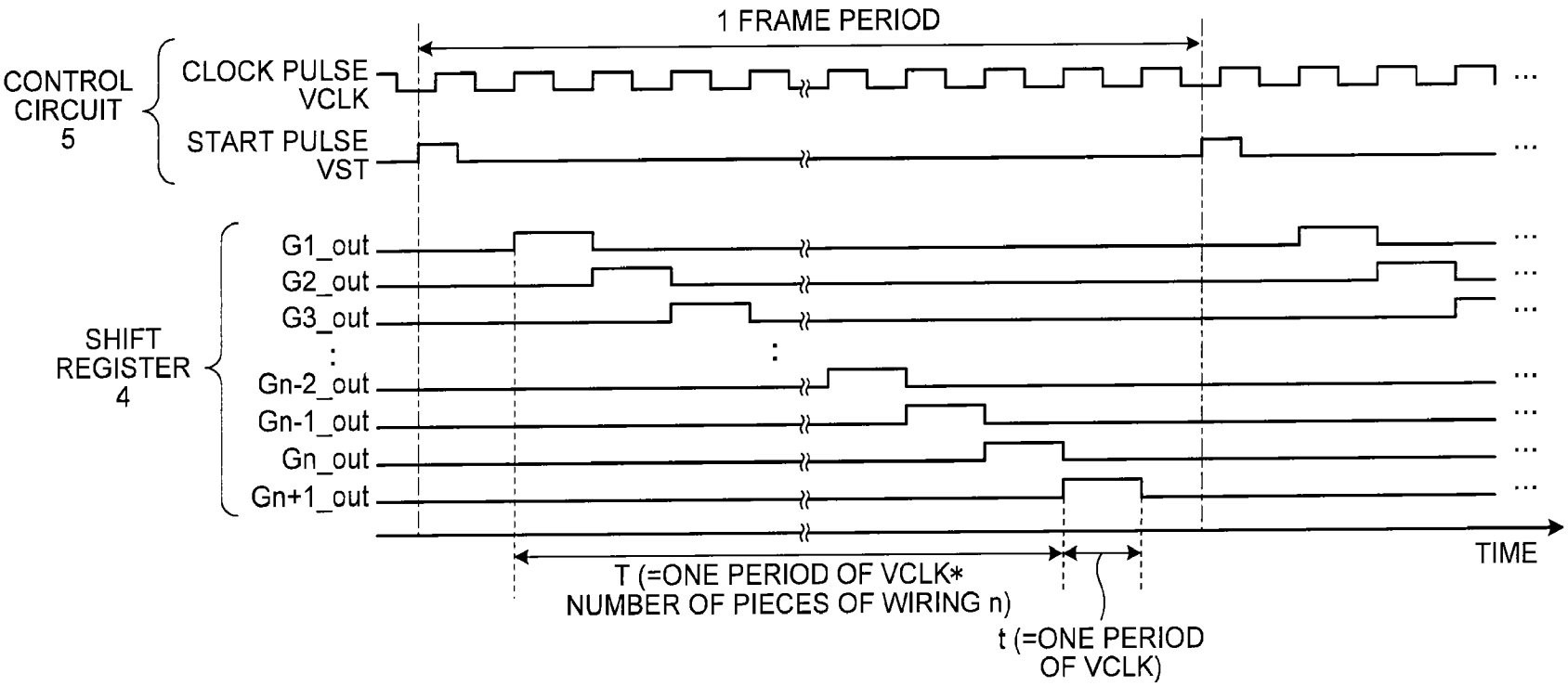
FIG. 2 is a diagram illustrating an example of a timing diagram of clock pulses, start pulses, and outputs of registers included in a shift register in the display device according to the first embodiment.
Figure 3:
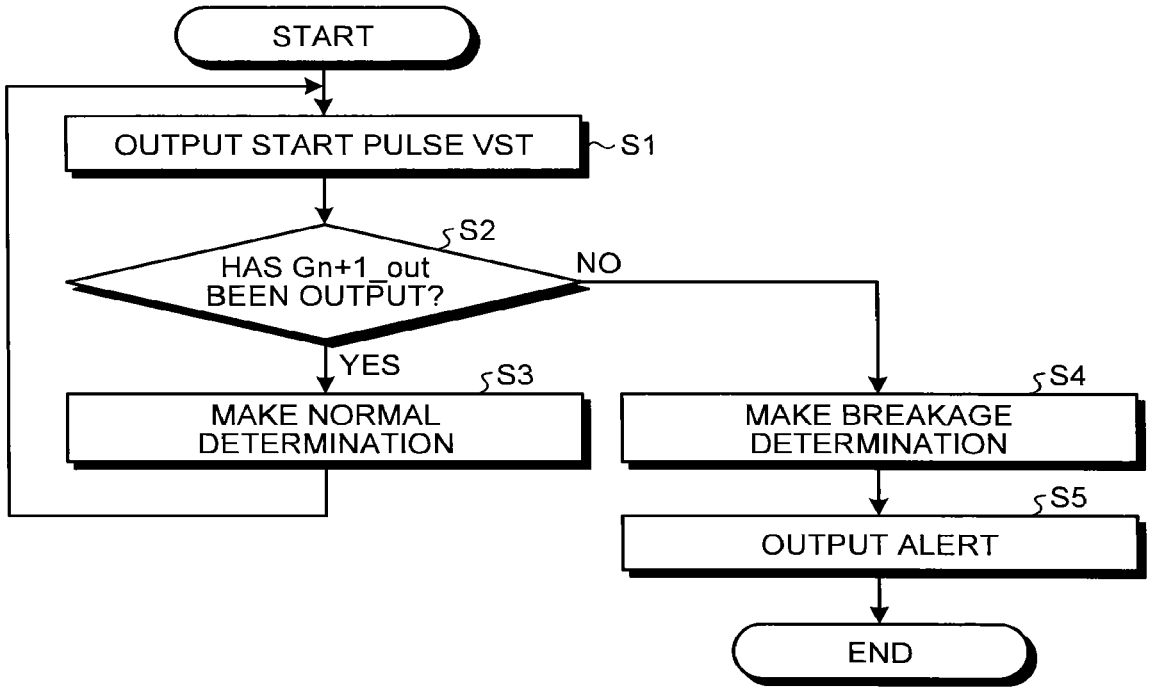
FIG. 3 is a diagram illustrating an example of a specific processing procedure in the display device according to the first embodiment.

The following describes a specific processing procedure in the display device 100 according to the first embodiment with reference to FIGS. 1 to 3. FIG. 2 is a diagram illustrating an example of a timing diagram of the clock pulses, the start pulses, and the outputs of the registers included in the shift register in the display device according to the first embodiment. FIG. 3 is a diagram illustrating an example of the specific processing procedure in the display device according to the first embodiment.

After the control circuit 5 outputs the start pulse VST (Step S1), each of the registers 3 included in the shift register 4 sequentially outputs an output pulse Gm_out (where m is 1 to n+1) of the register 3 in synchronization with the clock pulse VCLK while shifting the output pulse Gm_out by up to the number of stages (n+1 stages, in this case) of the registers 3.

The control circuit 5 determines whether the last register 3 of the shift register 4 has output the output pulse Gn+1_out in a breakage determination period t (=one period of VCLK) after a lapse of a wait time T (=one period of VCLK*the number of pieces of wiring) corresponding to a period in which the number of the clock pulses VCLK generated reaches the number of pieces of the wiring L (n, in this case) (Step S2). If the output pulse Gn+1_out has been output (Yes at Step S2), the control circuit 5 makes a normal determination that no breakage of the substrate 1 has been detected (Step S3), and returns the process to Step S1 to repeat the processing at Steps S1 and S2.

If the output pulse Gn+1_out has not been output (No at Step S2), the control circuit 5 determines that a breakage of the substrate 1 has been detected (Step S4), and outputs an alert to the higher-level system control unit (Step S5). Then, the process of this procedure ends.

As described above, in the present embodiment, the shift register 4, the control circuit 5, and the wiring for coupling the shift register 4 to the control circuit 5 are laid around the display area 2. As a result, the execution of the above-described processing procedure enables the detection of breakage of the shift register 4 or the control circuit 5, or the detection of disconnection in the wiring that couples the shift register 4 to the control circuit 5 and that includes the wiring 200 for transmitting the output Gn+1_out from the last register 3 of the shift register 4, and thus enables the detection of breakage in an area of the substrate 1 in the display device 100, the area ranging from the outer circumference of the substrate 1 to the display area 2.

Figure 4:
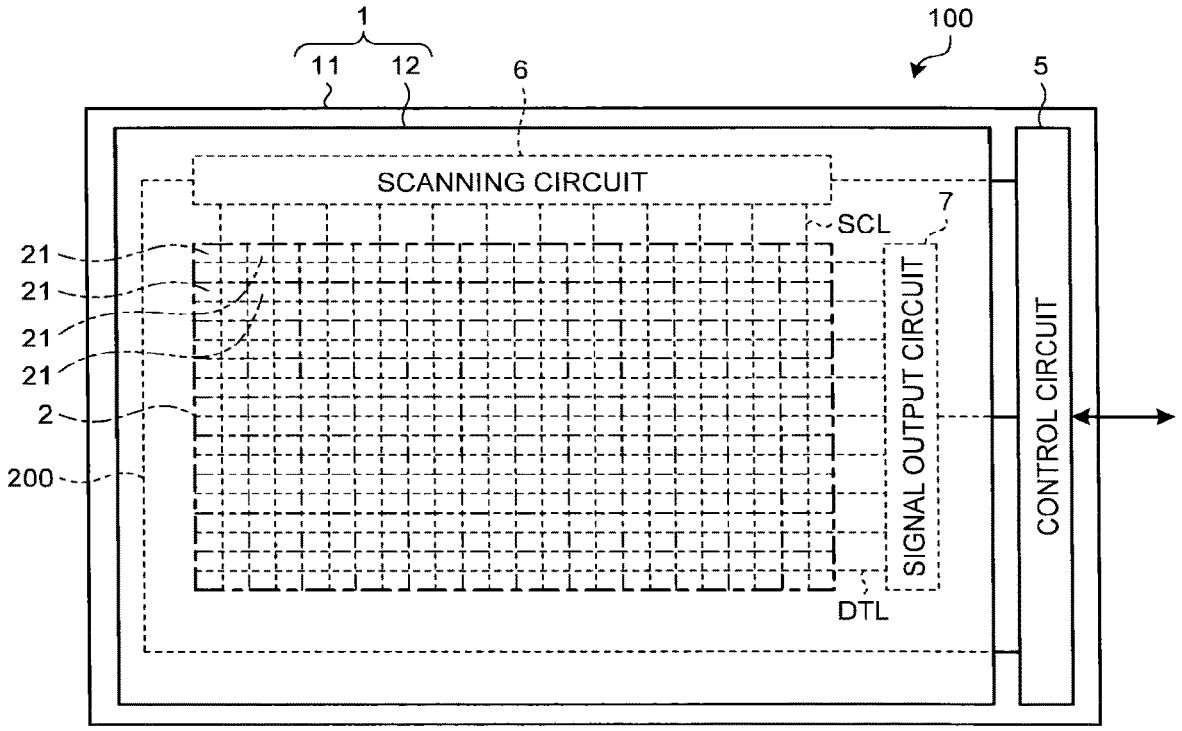
FIG. 4 is a diagram illustrating an example of a specific configuration example of the display device according to the first embodiment.

FIG. 4 is a diagram illustrating an example of a specific configuration example of the display device according to the first embodiment. In the example illustrated in FIG. 4, the display device 100 exemplifies a liquid crystal display device in which the substrate 1 includes a TFT substrate 11 and a CF glass substrate 12 placed so as to face the TFT substrate 11 with a liquid crystal layer interposed therebetween.

In the display device 100 illustrated in FIG. 4, a scanning circuit 6 includes the shift register 4 illustrated in FIG. 1, and the TFT substrate 11 is provided with the scanning circuit 6 and a signal output circuit 7, and also with the control circuit 5.

A plurality of pixels 21 are arranged in a matrix in the display area 2. Hereinafter, rows in which the pixels 21 are arranged in the direction of the rows are called pixel rows, and columns in which the pixels 21 are arranged in the direction of the columns are called pixel columns.

The control circuit 5 has, in addition to the function to output an alert in the event of detection of the breakage of the substrate 1, a function to control the scanning circuit 6 and the signal output circuit 7 based on externally received image data.

The signal output circuit 7 is what is called a source driver, and generates, based on image data output from the control circuit 5, video signals for driving the pixels 21 in the respective pixel rows, and outputs the video signals on a pixel-row-by-pixel-row basis via signal lines DTL.

The scanning circuit 6 is what is called a gate driver, and includes, for example, the shift register 4 and a buffer. The scanning circuit 6 generates scan signals according to synchronization signals output from the control circuit 5, and outputs the scan signals on a pixel-column-by-pixel-column basis via scanning lines SCL. The synchronization signals correspond to the clock pulses VCLK and the start pulses VST illustrated in FIG. 1, and the scanning lines SCL correspond to the wiring L illustrated in FIG. 1.

FIG. 4 illustrates an example in which the wiring for coupling the control circuit 5 to the scanning circuit 6 are provided to the TFT substrate 11, that is to say, the wiring illustrated in FIG. 1 including wiring for transmitting the clock pulse VCLK, wiring for transmitting the start pulse VST, and the wiring 200 for transmitting the output Gn+1_out from the last register 3 of the shift register 4 are provided to the TFT substrate 11. With this configuration, breakage of the TFT substrate 11 can be detected in an area ranging from the outer circumference thereof to the display area 2.

Figure 5:
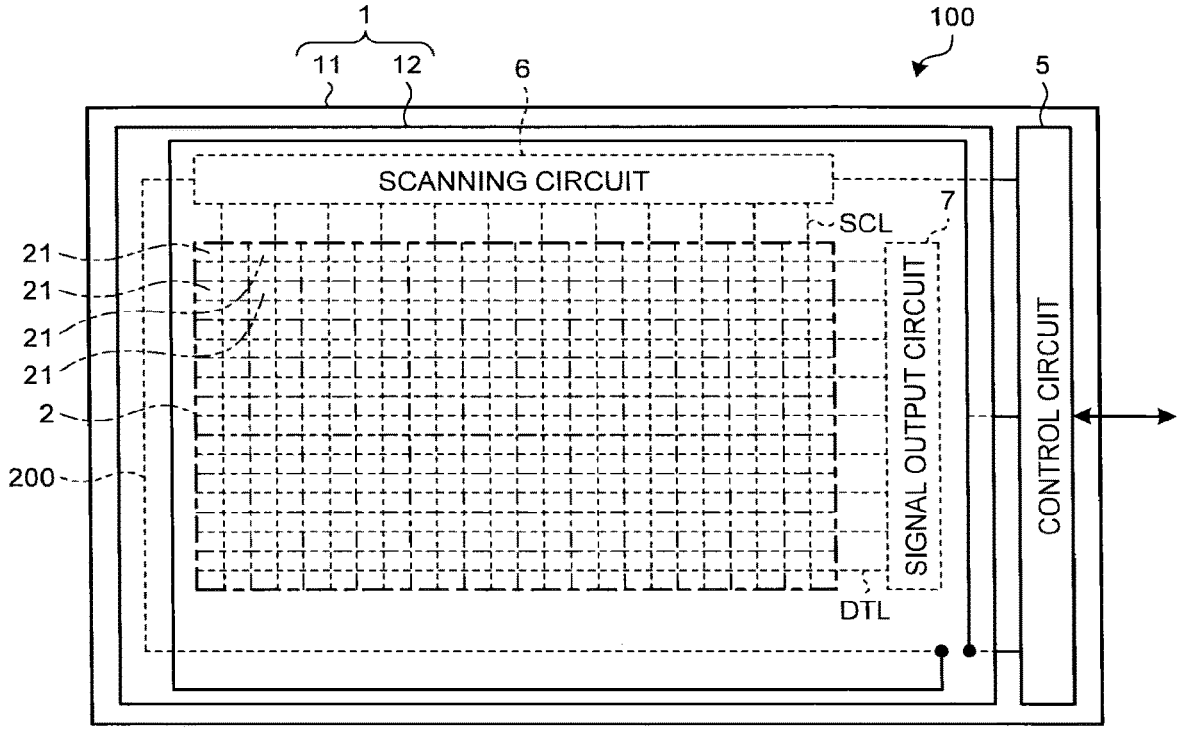
FIG. 5 is a diagram illustrating a modification of the specific configuration example of the display device according to the first embodiment.

FIG. 5 is a diagram illustrating a modification of the specific configuration example of the display device according to the first embodiment. FIG. 5 illustrates an example in which, of the pieces of wiring for coupling the control circuit 5 to the scanning circuit 6, the wiring 200 for transmitting the output Gn+1_out from the last register 3 of the shift register 4 illustrated in FIG. 1 is provided partially in an outer circumferential portion of the display area 2 on the CF glass substrate 12. With this configuration, breakage of the CF glass substrate 12 can also be detected in an area ranging from the outer circumference thereof to the display area 2. The wiring provided to the CF glass substrate side may be provided to either of the front and back surfaces of the CF glass substrate.

As described above, the display device 100 according to the first embodiment includes the shift register 4 and the control circuit 5. The shift register 4 includes the registers 3 coupled in series. The control circuit 5 supplies the clock pulse VCLK to each of the registers 3 and supplies the start pulse VST to the first register 3 of the shift register 4 to acquire the output from the last register 3 of the shift register 4. In the display device 100, the display area 2 is provided in the area surrounded by the shift register 4, the control circuit 5, and the wiring that couples the shift register 4 to the control circuit 5. Alternatively, the shift register 4 and the control circuit 5 are provided around the display area 2, and the wiring for coupling them is provided along the circumference of the display area 2. With this configuration, monitoring the output from the last register 3 of the shift register 4 enables the detection of breakage in an area of the substrate 1, the area ranging from the outer circumference of the substrate 1 to the display area 2.

The substrate 1 includes the TFT substrate 11 and the CF glass substrate 12 placed so as to face the TFT substrate 11 with the liquid crystal layer interposed therebetween. The TFT substrate 11 is provided with the control circuit 5 and the scanning circuit 6 that includes the shift register 4. In the configuration, the wiring for coupling the control circuit 5 to the scanning circuit 6 is provided to the TFT substrate 11. As a result, breakage of the TFT substrate 11 can be detected in the area ranging from the outer circumference thereof to the display area 2.

Furthermore, of the pieces of wiring for coupling the control circuit 5 to the scanning circuit 6, the wiring 200 for transmitting the output Gn+1_out from the last register 3 of the shift register 4 is provided partially in the outer circumferential portion of the display area 2 on the CF glass substrate 12, so that breakage of the CF glass substrate 12 can also be detected in the area ranging from the outer circumference thereof to the display area 2.

According to the present embodiment, the display device 100 can be provided that is capable of easily and quickly detecting the breakage of the display panel without causing an increase in the size of the device.

Second Embodiment

Figure 6:
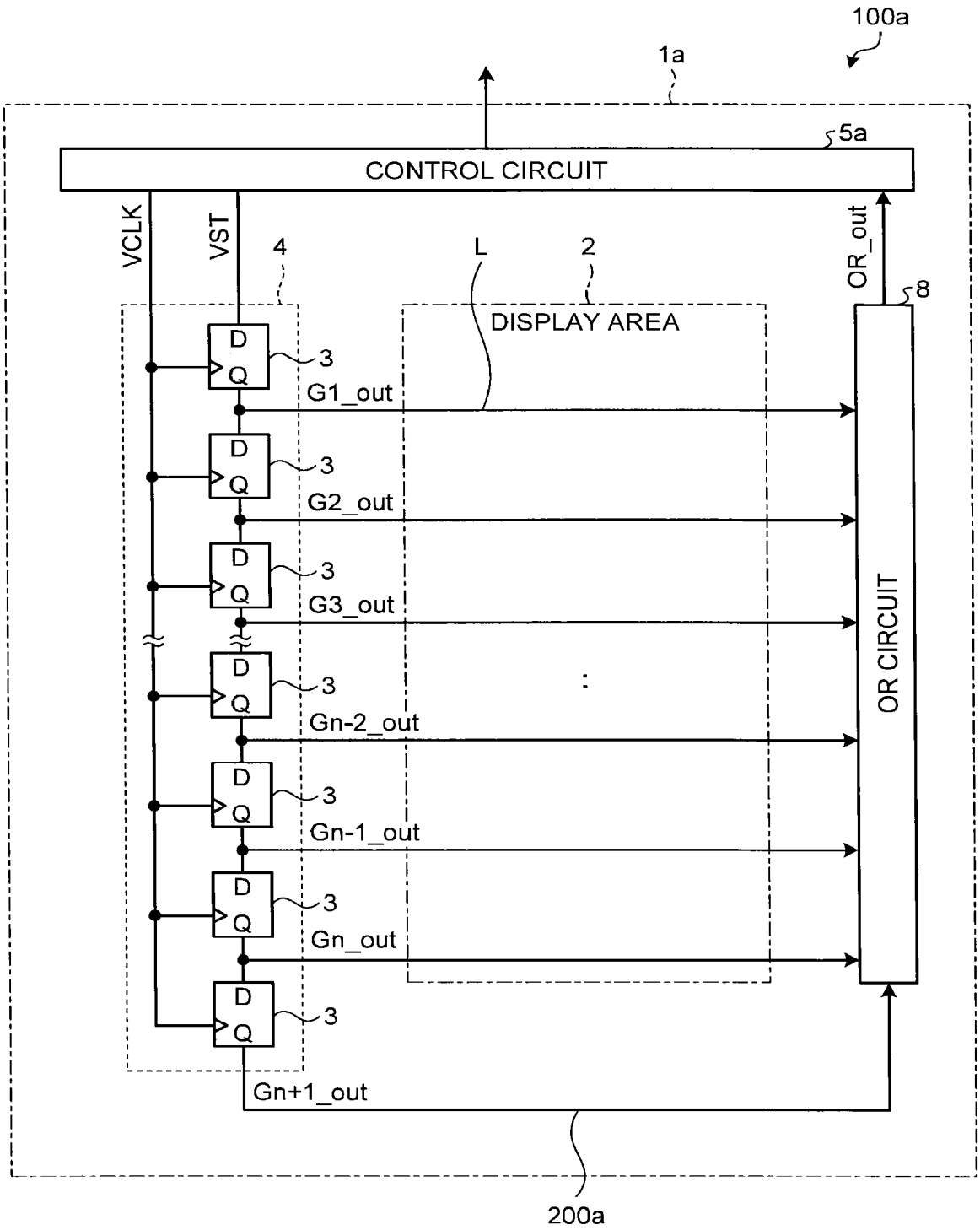
FIG. 6 is a diagram illustrating the schematic configuration of a display device according to a second embodiment.

FIG. 6 is a diagram illustrating the schematic configuration of a display device according to a second embodiment. The same components as those described in the embodiment described above are assigned with the same reference numerals, and the description thereof will not be repeated.

This display device 100*a* according to the present embodiment illustrated in FIG. 6 includes an OR circuit 8 in addition to the configuration of the first embodiment described above. In the display device 100*a*, the output end of the last register 3 of the shift register 4 is coupled to the other ends of the n pieces of the wiring L via the OR circuit 8, and an output OR_out from the OR circuit 8 is supplied to a control circuit 5*a*. That is, the present embodiment is configured such that a logical sum OR_out of outputs G1_out, G2_out, G3_out, . . . , Gn−2_out, Gn−1_out, and Gn_out of the n registers 3 that are supplied via the wiring L in the display area 2 is output to the control circuit 5*a*, in addition to the output Gn+1_out from the last register 3 of the shift register 4. In the present embodiment, the display area 2 is provided in an area surrounded by the shift register 4, the control circuit 5*a*, the OR circuit 8, and the wiring that couples the shift register 4, the control circuit 5*a*, and the OR circuit 8 to one another. Wiring 200*a* transmits the output Gn+1_out from the last register 3 of the shift register 4 and is laid so as to separate the display area 2 from an outer circumferential end of a substrate 1*a*.

Based on the output OR_out of the OR circuit 8, the control circuit 5*a* determines whether the substrate 1*a* has been broken. If a breakage of the substrate 1*a* has been detected, the control circuit 5*a* outputs an alert to the higher-level system control unit.

Figure 7:
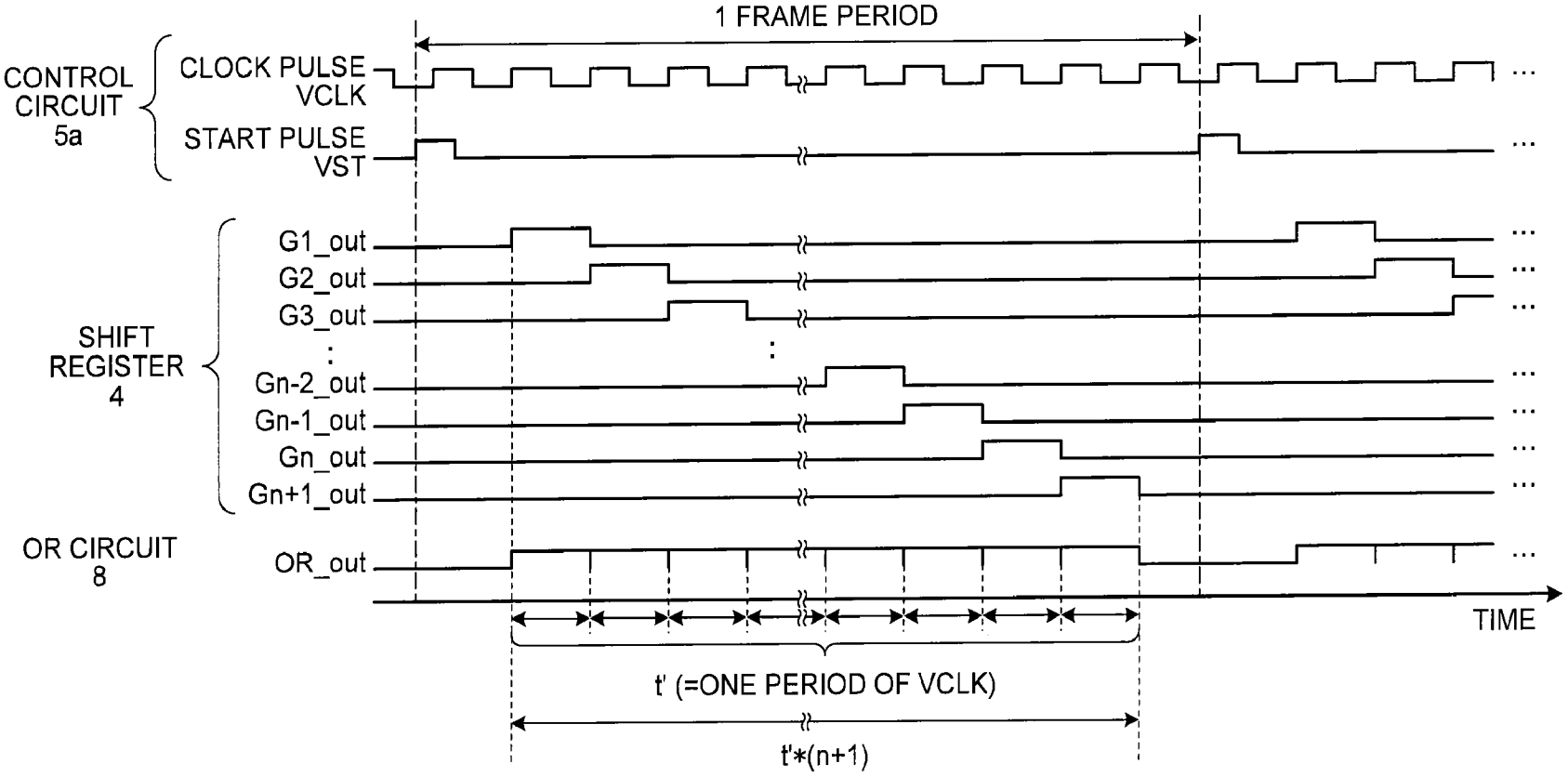
FIG. 7 is a diagram illustrating an example of a timing diagram of clock pulses, start pulses, outputs of registers included in a shift register, and outputs of an OR circuit in the display device according to the second embodiment.
Figure 8:
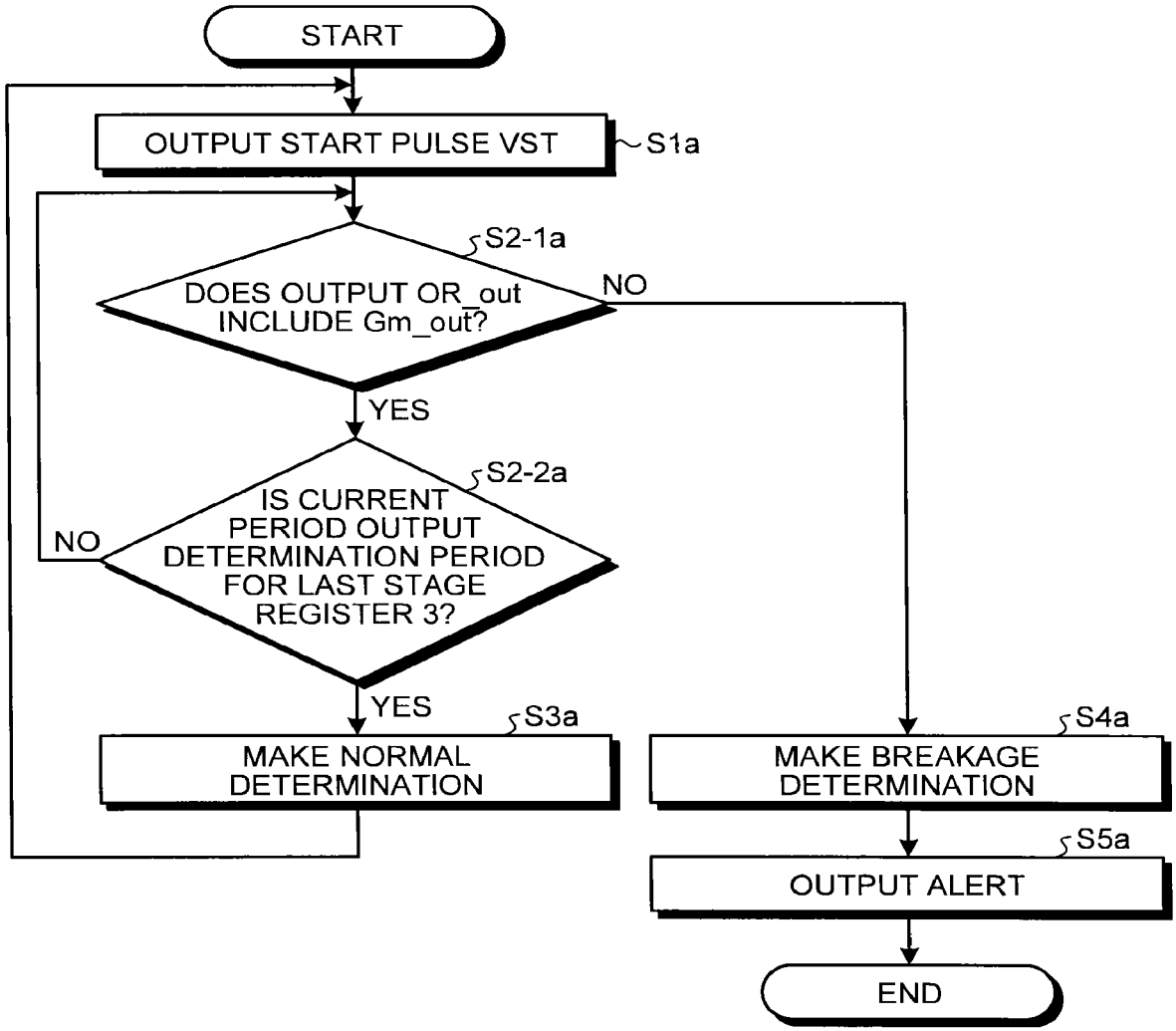
FIG. 8 is a diagram illustrating an example of a specific processing procedure in the display device according to the second embodiment.

The following describes a specific processing procedure in the display device 100*a* according to the second embodiment with reference to FIGS. 6 to 8. FIG. 7 is a diagram illustrating an example of a timing diagram of the clock pulses, the start pulses, the outputs of the registers included in the shift register, and the outputs of the OR circuit in the display device according to the second embodiment. FIG. 8 is a diagram illustrating an example of a specific processing procedure in the display device according to the second embodiment.

After the control circuit 5*a* outputs the start pulse VST (Step S1*a*), each of the registers 3 included in the shift register 4 sequentially outputs the output pulse Gm_out (where m is 1 to n+1) of the register 3 in synchronization with the clock pulse VCLK while shifting the output pulse Gm_out by up to the number of stages (n+1 stages, in this case) of the registers 3.

At intervals of a breakage determination period t' (=one period of VCLK) for each of the registers 3 included in the shift register 4, the control circuit 5*a* determines whether the output OR_out of the OR circuit 8 includes the output pulse Gm_out of the register 3 (Step S2-1*a*). If the output pulse Gm_out is output (Yes at Step S2-1*a*), the control circuit 5*a* subsequently determines whether the current period is the output determination period for the last register 3 (Step S2-2*a*). If not (No at Step S2-2*a*), the control circuit 5*a* returns the process to Step 2-1*a* to repeat the processing at Steps S2-1*a* and S2-2*a*. With this process, all the registers 3 included in the shift register 4 can be determined as to whether each of them has output the output pulse Gm_out during the whole breakage determination period t'*(n+1).

If the current period is the output determination period for the last register 3 (Yes at Step S2-2*a*), the control circuit 5*a* makes the normal determination that no breakage of the substrate 1*a* has been detected (Step S3*a*), and returns the process to Step S1*a* to repeat the processing at Steps S1*a* to S2-2*a*.

If, at Step S2-1*a*, the output OR_out of the OR circuit 8 does not include the output pulse Gm_out of each of the register 3 (No at Step S2-1*a*), the control circuit 5*a* determines that a breakage of the substrate 1*a* has been detected (Step S4*a*), and outputs an alert to the higher-level system control unit (Step S5*a*). Then, the process of this procedure ends.

As described above, in the present embodiment, the shift register 4, the control circuit 5*a*, the OR circuit 8, and the wiring for coupling the shift register 4, the control circuit 5*a*, and the OR circuit 8 to one another are laid around the display area 2. As a result, the execution of the above-described processing procedure enables the detection of breakage of the shift register 4, the control circuit 5*a*, or the OR circuit 8, or the detection of disconnection in the wiring that couples together the shift register 4, the control circuit 5*a*, and the OR circuit 8 and that includes the wiring 200*a* for transmitting the output Gn+1_out from the last register 3 of the shift register 4, and thus enables the detection of breakage in an area of the substrate 1*a* in the display device 100*a*, the area ranging from the outer circumference of the substrate 1*a* to the display area 2. The present embodiment is configured such that the logical sum OR_out of outputs G1_out, G2_out, G3_out, . . . , Gn−2 out, Gn−1_out, and Gn_out of the n registers 3 that are supplied via the wiring L in the display area 2 is output to the control circuit 5*a*, in addition to the output Gn+1_out from the last register 3 of the shift register 4. As a result, the breakage in the display area 2 can be detected at an earlier time and detected as a more specific position.

Figure 9:
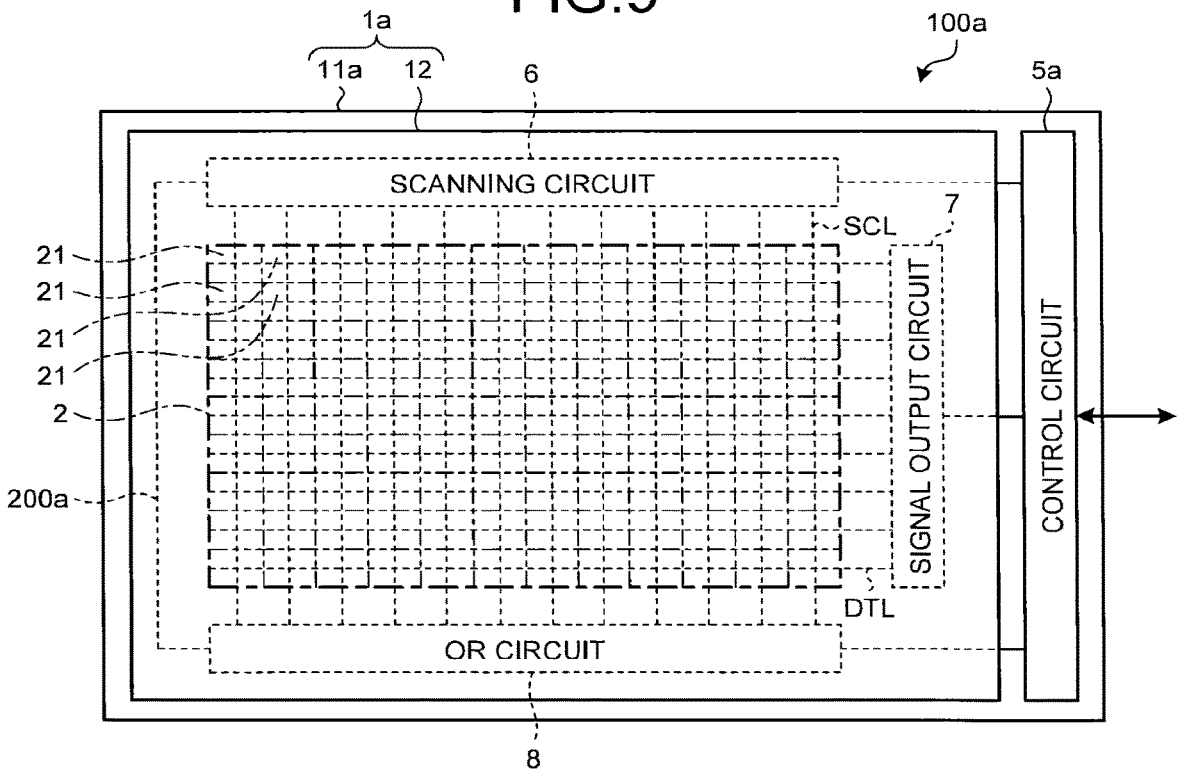
FIG. 9 is a diagram illustrating an example of a specific configuration example of the display device according to the second embodiment.

FIG. 9 is a diagram illustrating an example of a specific configuration example of the display device according to the second embodiment. In the example illustrated in FIG. 9, the display device 100*a* exemplifies a liquid crystal display device in which the substrate in includes a TFT substrate 11*a* and the CF glass substrate 12 placed so as to face the TFT substrate 11*a* with a liquid crystal layer interposed therebetween.

In the display device 100*a* illustrated in FIG. 9, the OR circuit 8 is provided to the TFT substrate 11*a* in the same manner as the scanning circuit 6 and the signal output circuit 7.

In the same manner as in the first embodiment, the control circuit 5*a* has, in addition to the function to output an alert in the event of detection of the breakage of the substrate 1*a*, the function to control the scanning circuit 6 and the signal output circuit 7 based on externally received image data.

FIG. 9 illustrates an example in which the wiring for coupling together the control circuit 5*a*, the scanning circuit 6, and the OR circuit 8 are provided to the TFT substrate 11*a*, that is to say, the wiring illustrated in FIG. 6 including wiring for transmitting the clock pulse VCLK, wiring for transmitting the start pulse VST, the wiring 200*a* for transmitting the output Gn+1_out from the last register 3 of the shift register 4, and wiring for transmitting the output OR_out of the OR circuit 8 are provided to the TFT substrate 11*a*. With this configuration, a breakage in an area including the display area 2 on the TFT substrate 11*a* can be detected, and the breakage in the display area 2 on the TFT substrate 11*a* can be detected at an earlier time and detected as a more specific position.

Figure 10:
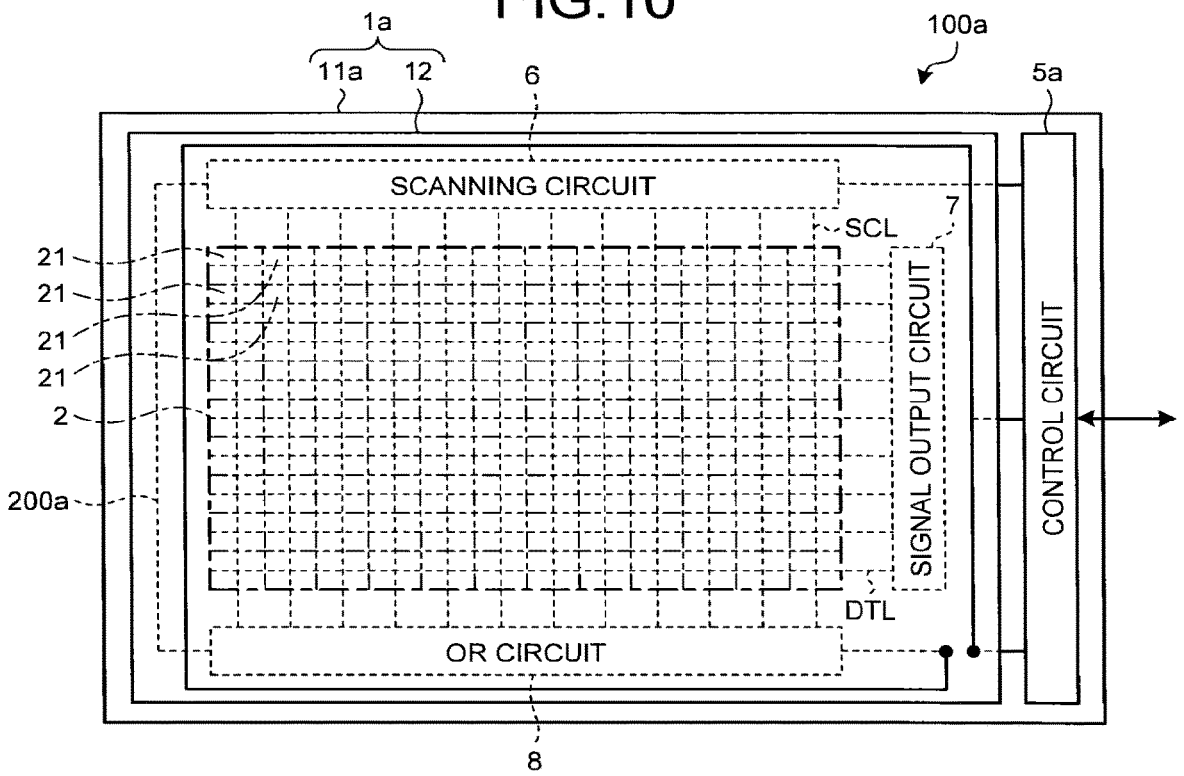
FIG. 10 is a diagram illustrating a modification of the specific configuration example of the display device according to the second embodiment.

FIG. 10 is a diagram illustrating a modification of the specific configuration example of the display device according to the second embodiment. FIG. 10 illustrates an example in which, of the pieces of wiring for coupling together the control circuit 5*a*, the scanning circuit 6, and the OR circuit 8, the wiring for transmitting the output OR_out of the OR circuit 8 illustrated in FIG. 6 is provided partially in the outer circumferential portion of the display area 2 on the CF glass substrate 12. With this configuration, the breakage in the display area 2 on the CF glass substrate 12 can also be detected.

As described above, the display device 100*a* according to the second embodiment includes the OR circuit 8 in addition to the configuration of the first embodiment. The display area 2 is provided in the area surrounded by the shift register 4, the control circuit 5*a*, the OR circuit 8, and the wiring that couples the shift register 4, the control circuit 5*a*, and the OR circuit 8 to one another. The output end of the last register 3 of the shift register 4 is coupled to the other ends of the n pieces of the wiring L via the OR circuit 8, and the output OR_out of the OR circuit 8 is supplied to the control circuit 5*a*. With this configuration, monitoring the output of the output OR_out from the OR circuit 8 enables the detection of breakage in an area of the substrate 1*a* in the display device 100*a*, the area ranging from the outer circumference of the substrate 1*a* to the display area 2. The display device 100*a* is configured such that the control circuit 5*a* is supplied not only with the output Gn+1_out from the last register 3 of the shift register 4 but also with the logical sum OR_out of the outputs G1_out, G2_out, G3_out, . . . , Gn−2 out, Gn−1_out, and Gn_out of the n registers 3. The outputs G1_out, G2_out, G3_out, . . . , Gn−2_out, Gn−1_out, and Gn_out of the n registers 3 are supplied to the OR circuit 8 via the wiring L in the display area 2. As a result, the breakage in the display area 2 can be detected at an earlier time and detected as a more specific position.

The substrate 1*a* includes the TFT substrate 11*a* and the CF glass substrate 12 placed so as to face the TFT substrate 11*a* with the liquid crystal layer interposed therebetween. The TFT substrate 11*a* is provided thereon with the control circuit 5*a*, the scanning circuit 6 including the shift register 4, and the OR circuit 8. In the configuration, the wiring for coupling the control circuit 5*a*, the scanning circuit 6, and the OR circuit 8 to one another are provided to the TFT substrate 11*a*. As a result, breakage of the TFT substrate 11*a* can be detected in the area ranging from the outer circumference thereof to the display area 2. The display device 100*a* is configured such that the control circuit 5*a* is supplied not only with the output Gn+1_out from the last register 3 of the shift register 4 but also with the logical sum OR_out of the outputs G1_out, G2_out, G3_out, . . . , Gn−2 out, Gn−1_out, and Gn_out of the n registers 3. The outputs G1_out, G2_out, G3_out, . . . , Gn−2 out, Gn−1_out, and Gn_out of the n registers 3 are supplied to the OR circuit 8 via the wiring L in the display area 2. As a result, the breakage in the display area 2 on the TFT substrate 11*a* can be detected at an earlier time and detected as a more specific position.

Furthermore, of the pieces of wiring for coupling the control circuit 5*a*, the scanning circuit 6, and the OR circuit 8 to one another, the wiring for transmitting the output OR_out of the OR circuit 8 is provided partially in the outer circumferential portion of the display area 2 on the CF glass substrate 12, so that breakage of the CF glass substrate 12 can also be detected in the area ranging from the outer circumference thereof to the display area 2.

According to the present embodiment, the display device 100*a* can be provided that is capable of easily and quickly detecting the breakage of the display panel without causing an increase in the size of the device.

Third Embodiment

Figure 11:
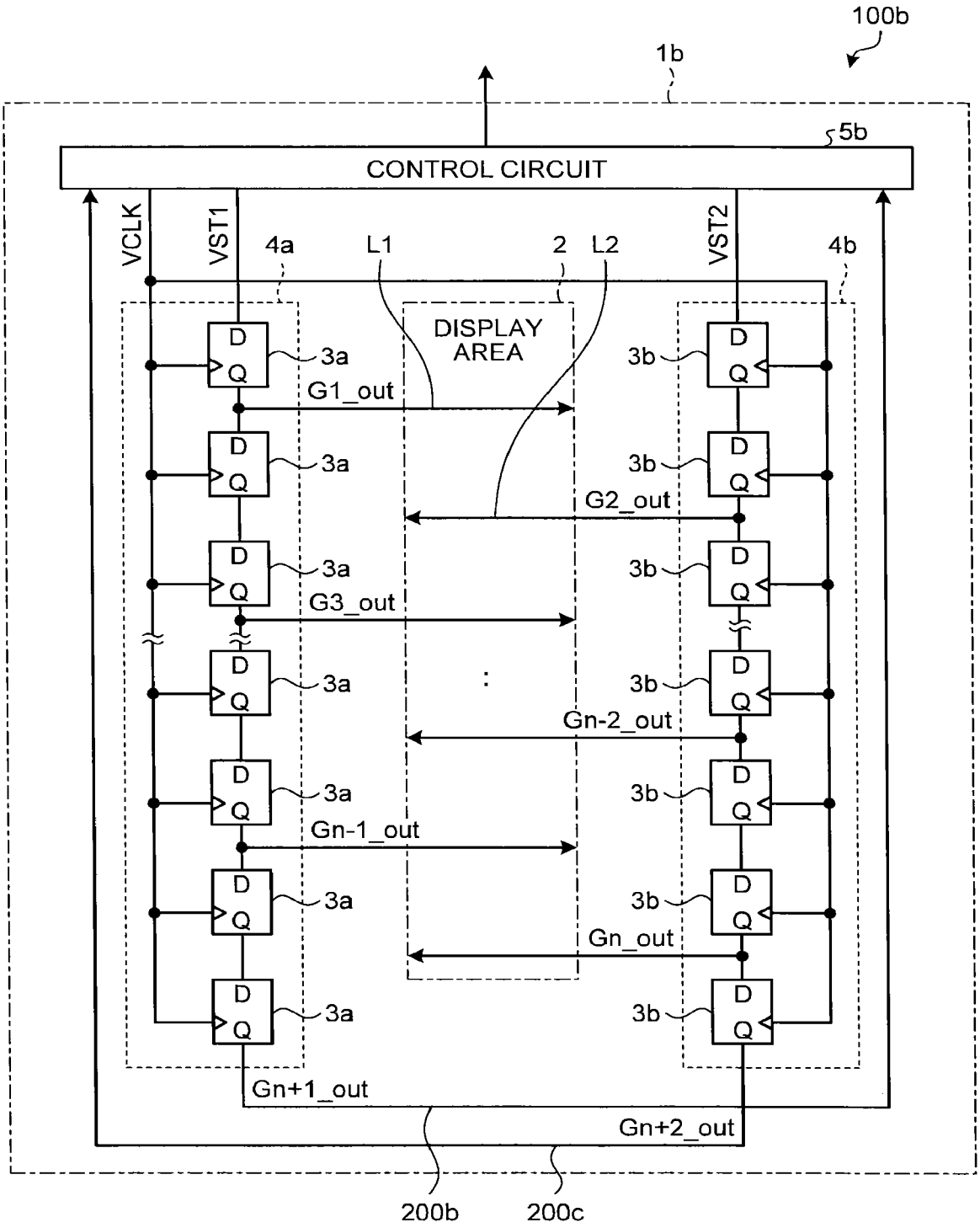
FIG. 11 is a diagram illustrating the schematic configuration of a display device according to a third embodiment.

FIG. 11 is a diagram illustrating the schematic configuration of a display device according to a third embodiment. The same components as those described in any of the embodiments described above are assigned with the same reference numerals, and the description thereof will not be repeated.

As illustrated in FIG. 11, this display device 100*b* includes the display area 2, shift registers 4*a* and 4*b*, and a control circuit 5*b*. The display are 2 is provided to a substrate 1*b*. The shift registers 4*a* and 4*b* are arranged along opposed sides of the display area 2, respectively. The control circuit 5*b* supplies the clock pulse VCLK to each of a plurality of registers 3*a* included in the shift register 4*a* and to each of a plurality of registers 3*b* included in the shift register 4*b*. The control circuit 5*b* also supplies a start pulse VST1 to a register 3*a* at the first stage (hereinafter referred to as the first register 3*a*) of the shift register 4*a* to acquire an output Gn+1_out from a register 3*a* at the last stage (hereinafter referred to as the last register 3*a*) of the shift register 4*a*. The control circuit 5*b* also supplies a start pulse VST2 to a register 3*b* at the first stage (hereinafter referred to as the first register 3*b*) of the shift register 4*b* to acquire an output pulse Gn+2 out from a register 3*b* at the last stage (hereinafter referred to as the last register 3*b*) of the shift register 4*b*.

In the present embodiment, the display area 2 is provided in an area surrounded by the shift register 4*a*, the shift register 4*b*, the control circuit 5*b*, and wiring that couples the shift register 4*a*, the shift register 4*b*, and the control circuit 5*b* to one another. Wiring 200*b* for transmitting the output Gn+1_out from the last register 3*a* of the shift register 4*a* and wiring 200*c* for transmitting the output pulse Gn+2_out from the last register 3*b* of the shift register 4*b* are laid so as to separate the display area 2 from outer circumferential ends of the substrate 1*b*. Each of the shift registers 4*a* and 4*b* has the same configuration as that of the shift register 4 according to the first embodiment. In the display area 2, n/2 pieces of wiring L1 (where n is an even number) and n/2 pieces of wiring L2 are arranged alternately with each other. One end of each of the n/2 pieces of the wiring L1 is coupled to a corresponding coupling portion between the registers 3*a*, and the other end of each of the n/2 pieces of the wiring L2 is coupled to a corresponding coupling portion between the registers 3*b*.

Based on the output Gn+1_out from the last register 3*a* of the shift register 4*a* and the output pulse Gn+2_out from the last register 3*b* of the shift register 4*b*, the control circuit 5*b* determines whether the substrate 1*b* has been broken. If a breakage of the substrate 1*b* has been detected, the control circuit 5*b* outputs an alert to the higher-level system control unit.

Figure 12:
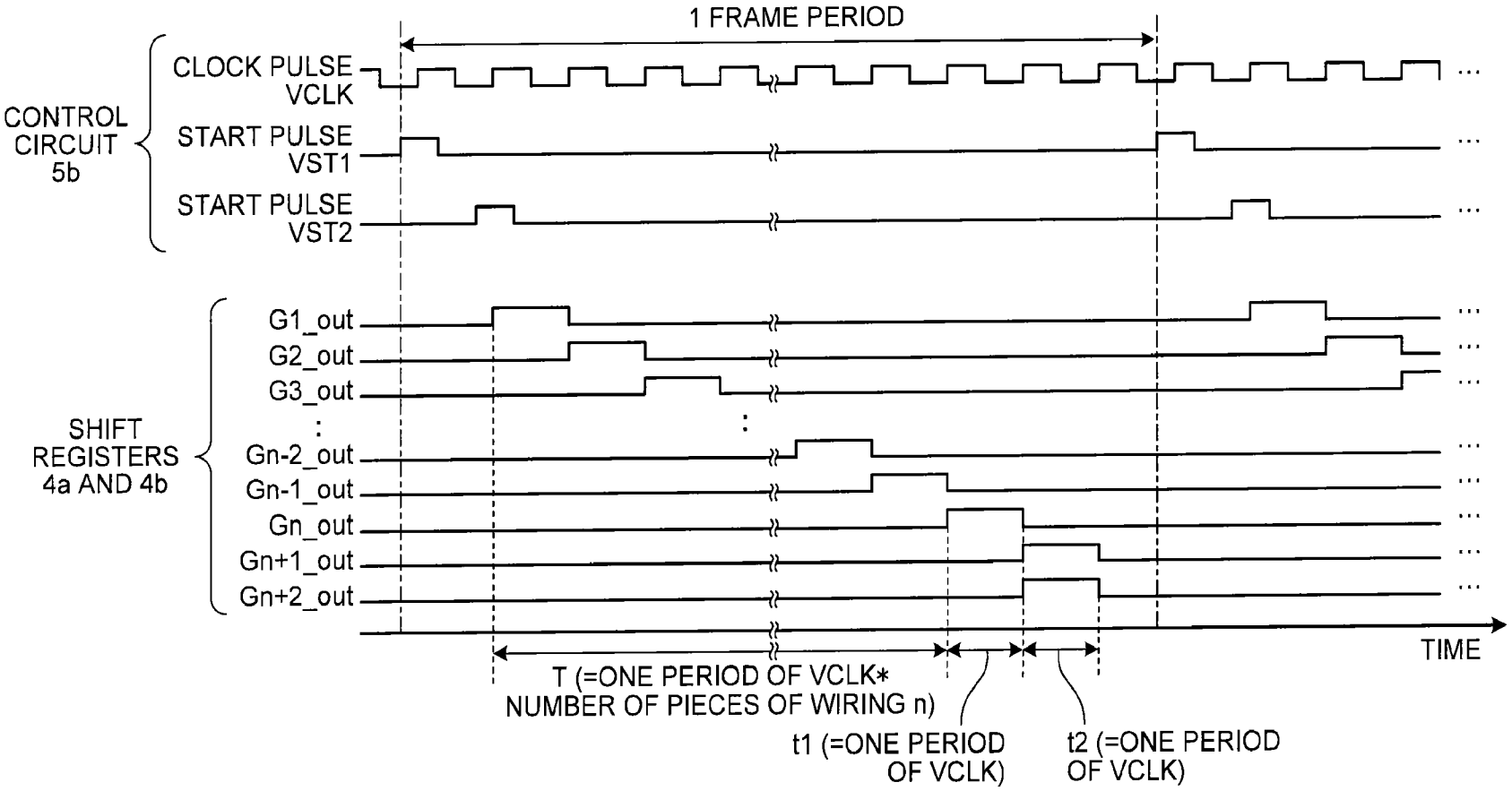
FIG. 12 is a diagram illustrating an example of a timing diagram of clock pulses, start pulses, and outputs of registers included in shift registers in the display device according to the third embodiment.
Figure 13:
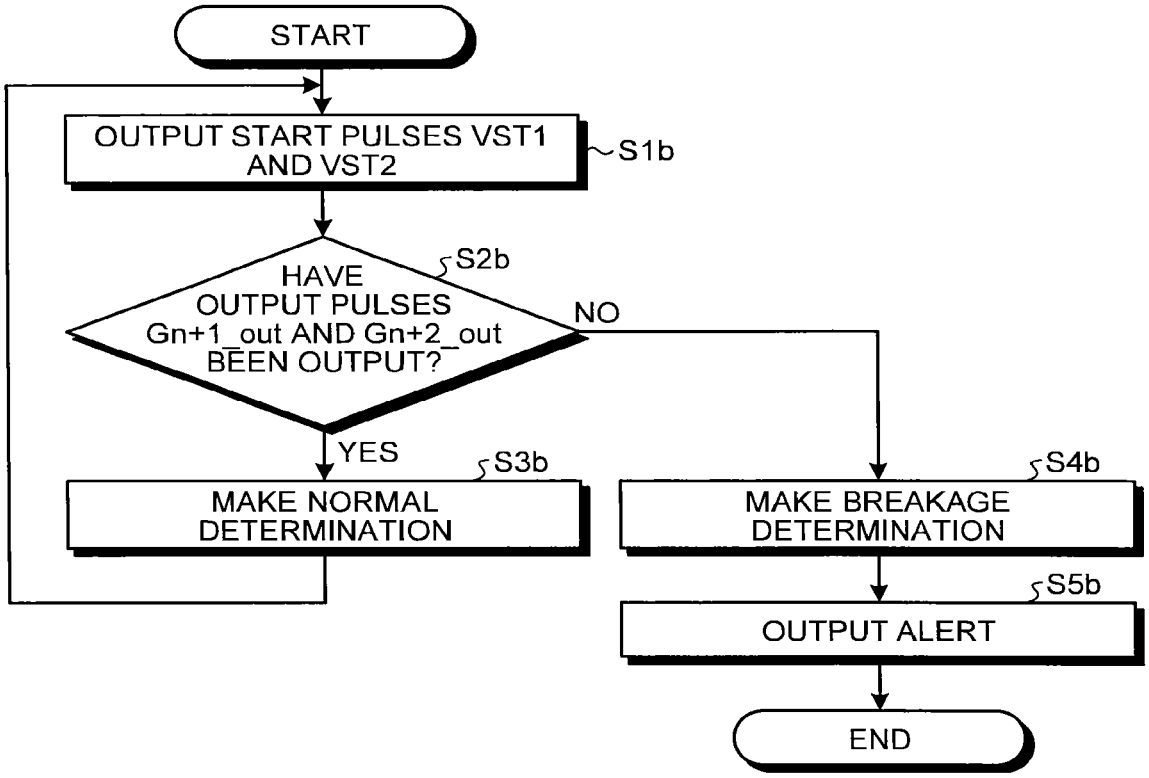
FIG. 13 is a diagram illustrating an example of a specific processing procedure in the display device according to the third embodiment.

The following describes a specific processing procedure in the display device 100*b* according to the third embodiment with reference to FIGS. 11 to 13. FIG. 12 is a diagram illustrating an example of a timing diagram of the clock pulses, the start pulses, and the outputs of the registers included in the shift registers in the display device according to the third embodiment. FIG. 13 is a diagram illustrating an example of a specific processing procedure in the display device according to the third embodiment.

After the control circuit 5*b* outputs the start pulses VST1 and VST2 (Step S1*b*), each of the registers 3*a* included in the shift register 4*a* sequentially outputs an output pulse Gm1_out (where m1 is an odd number in the range of 1 to n+1) of the register 3*a* in synchronization with the clock pulse VCLK while shifting the output pulse Gm1_out by up to the number of stages (n+1 stages, in this case) of the registers 3*a*. At the same time, each of the registers 3*b* included in the shift register 4*b* sequentially outputs an output pulse Gm2_out (where m2 is an even number in the range of 2 to n+2) of the register 3*b* in synchronization with the clock pulse VCLK while shifting the output pulse Gm2_out by up to the number of stages (n+1 stages, in this case) of the registers 3*b*.

The control circuit 5*b* determines whether the last register 3*a* of the shift register 4*a* has output the output pulse Gn+1_out in a breakage determination period t1 (=one period of VCLK) after a lapse of the wait time T (=one period of VCLK*the number of pieces of wiring) corresponding to a period in which the number of the clock pulses VCLK generated reaches the number of pieces of the wiring L1 and L2 (n, in this case), and also determines whether the last register 3*b* of the shift register 4*b* has output the output pulse Gn+2_out in a breakage determination period t2 (=one period of VCLK) after a lapse of a period obtained by adding the breakage determination period t1 to the wait time T (Step S2*b*). If both the output pulses Gn+1_out and Gn+2_out have been output (Yes at Step S2*b*), the control circuit 5*b* makes the normal determination that no breakage of the substrate 1*b* has been detected (Step S3*b*), and returns the process to Step S1*b* to repeat the processing at Steps S1*b* and S2*b*.

If at least one of the output pulses Gn+1_out and Gn+2_out has not been output (No at Step S2*b*), the control circuit 5*b* determines that a breakage of the substrate 1*b* has been detected (Step S4*b*), and outputs an alert to the higher-level system control unit (Step S5*b*). Then, the process of this procedure ends.

As described above, in the present embodiment, the shift registers 4*a* and 4*b*, the control circuit 5*b*, and the wiring for coupling the shift registers 4*a* and 4*b* and the control circuit 5*b* to one another are laid around the display area 2. As a result, the execution of the above-described processing procedure enables the detection of breakage of the shift register 4*a* or 4*b* or the control circuit 5*b*, or the detection of disconnection in the wiring that couples together the shift registers 4*a* and 4*b*, and the control circuit 5*a* and that include the wiring 200*b* for transmitting the output Gn+1_out from the last register 3*a* of the shift register 4*a* and the wiring 200*c* for transmitting the output Gn+2_out from the last register 3*b* of the shift register 4*b*, and thus enables the detection of breakage in an area of the substrate 1*b* in the display device 100*b*, the area ranging from the outer circumference of the substrate 1*b* to the display area 2.

Figure 14:
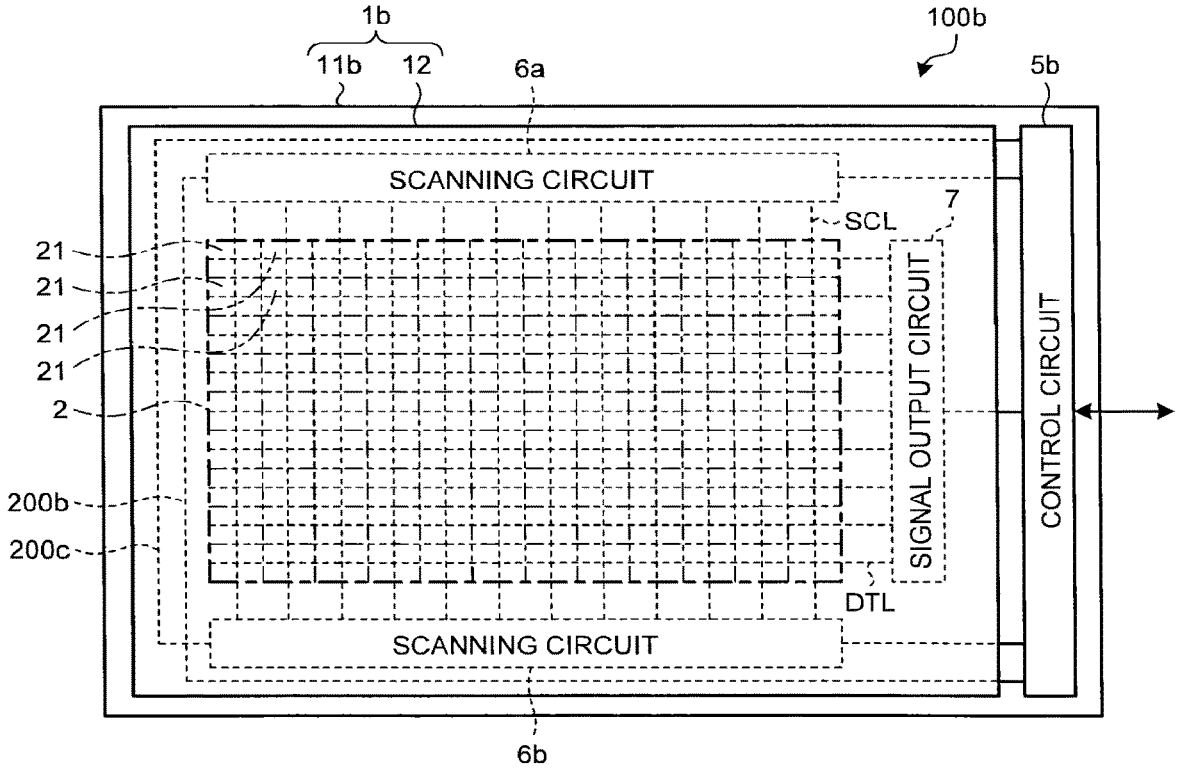
FIG. 14 is a diagram illustrating an example of a specific configuration example of the display device according to the third embodiment.

FIG. 14 is a diagram illustrating an example of a specific configuration example of the display device according to the third embodiment. In the example illustrated in FIG. 14, the display device 100*b* exemplifies a liquid crystal display device in which the substrate 1*b* includes a TFT substrate 11*b* and the CF glass substrate 12 placed so as to face the TFT substrate 11*b* with a liquid crystal layer interposed therebetween.

In the display device 100*b* illustrated in FIG. 14, a scanning circuit 6*a* includes the shift register 4*a* illustrated in FIG. 11; a scanning circuit 6*b* includes the shift register 4*b* illustrated in FIG. 11; and the TFT substrate 11*b* is provided with the scanning circuits 6*a* and 6*b* and the signal output circuit 7, and also with the control circuit 5*b*.

In the same manner as in the first and second embodiments, the control circuit 5*b* has, in addition to the function to output an alert in the event of detection of the breakage of the substrate 1*b*, a function to control the scanning circuits 6*a* and 6*b* and the signal output circuit 7 based on the externally received image data.

FIG. 14 illustrates an example in which the wiring for coupling together the control circuit 5*b* and the scanning circuits 6*a* and 6*b* are provided to the TFT substrate 11*b*, that is to say, the wiring illustrated in FIG. 11 including wiring for transmitting the clock pulse VCLK, wiring for transmitting the start pulses VST1 and VST2, the wiring 200*b* for transmitting the output Gn+1_out from the last register 3*a* of the shift register 4*a*, and the wiring 200*c* for transmitting the output Gn+2_out from the last register 3*b* of the shift register 4*b* are provided to the TFT substrate 11*b*. In this example, the wiring 200*b* for transmitting the output Gn+1_out from the last register 3*a* of the shift register 4*a* and the wiring 200*c* for transmitting the output Gn+2_out from the last register 3*b* of the shift register 4*b* intersect each other while being insulated from each other.

Figure 15:
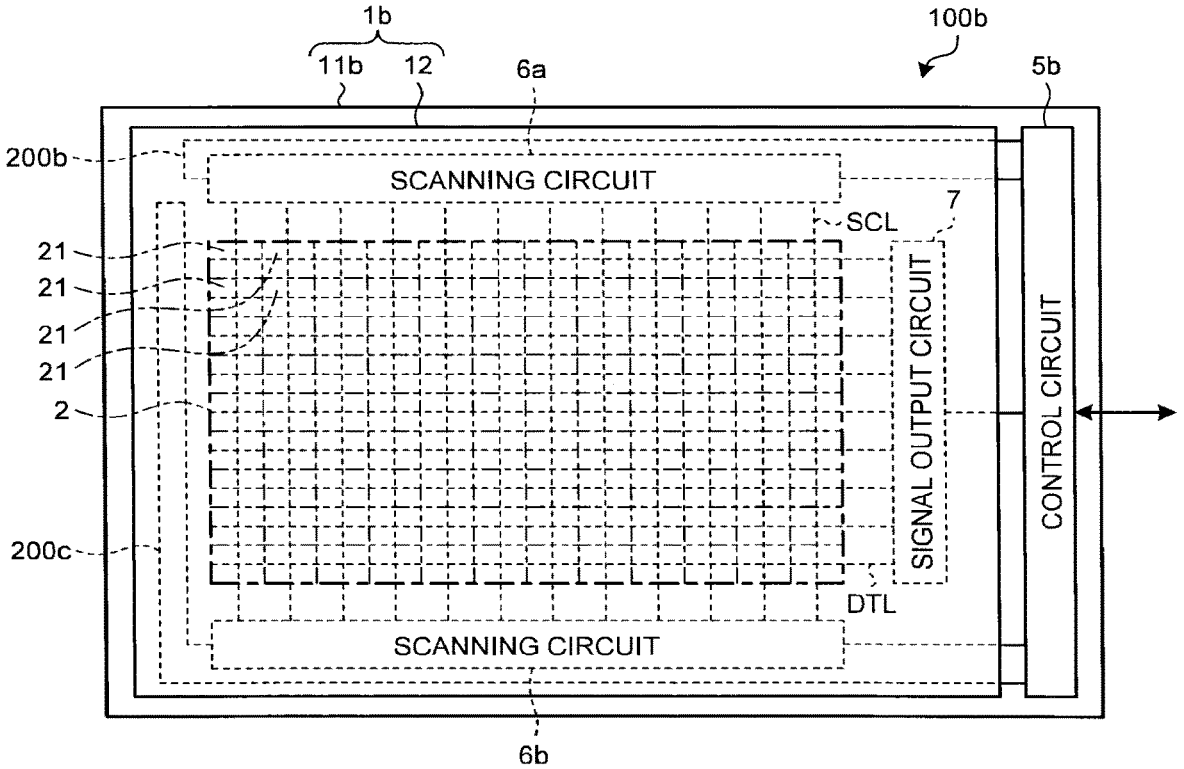
FIG. 15 is a diagram illustrating a modification of the specific configuration example of the display device according to the third embodiment.

FIG. 15 is a diagram illustrating a modification of the specific configuration example of the display device according to the third embodiment. The example illustrated in FIG. 15 illustrates an example in which, on the TFT substrate 11*b*, the wiring 200*b* for transmitting the output Gn+1_out from the last register 3*a* of the shift register 4*a* does not intersect the wiring 200*c* for transmitting the output Gn+2_out from the last register 3*b* of the shift register 4*b*.

With the configuration illustrated in FIGS. 14 and 15, breakage of the TFT substrate 11*b* can be detected in the area ranging from the outer circumference thereof to the display area 2.

Figure 16:
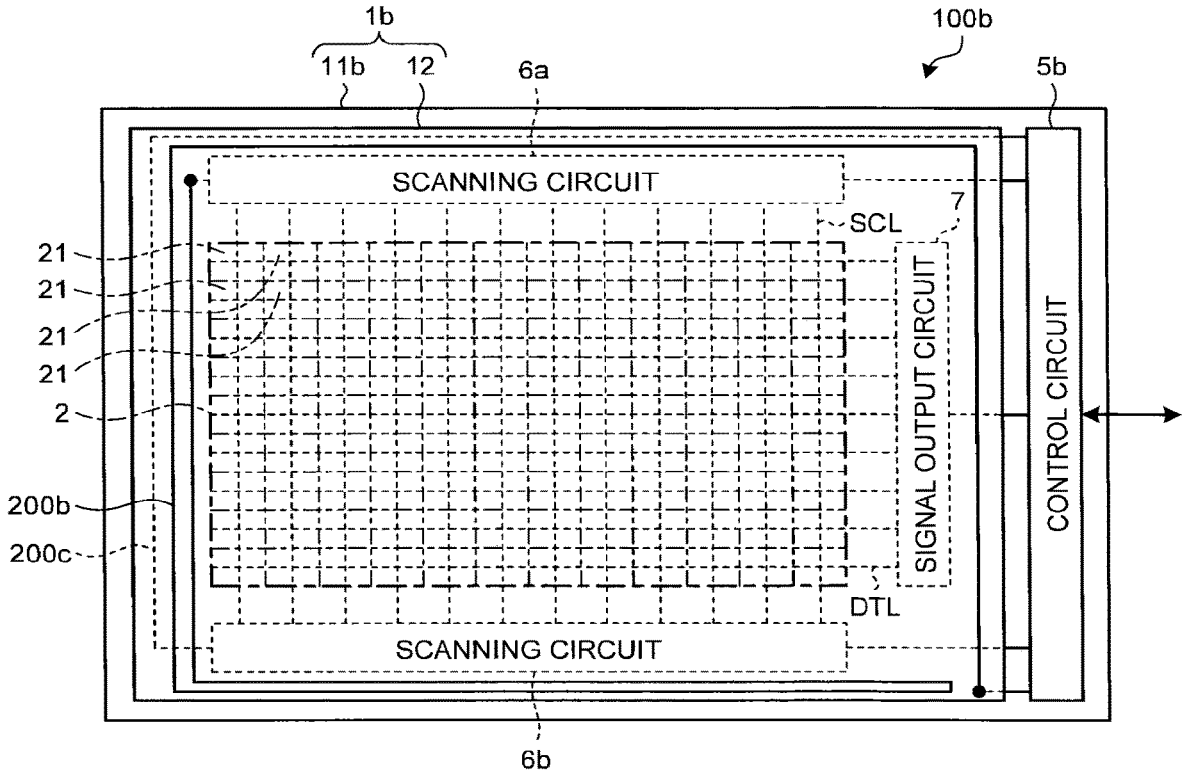
FIG. 16 is a diagram illustrating another modification, different from that of FIG. 15, of the specific configuration example of the display device according to the third embodiment.

FIG. 16 is a diagram illustrating another modification, different from that of FIG. 15, of the specific configuration example of the display device according to the third embodiment. The example illustrated in FIG. 16 illustrates an example in which, of the pieces of wiring for coupling the control circuit 5*b* and the scanning circuits 6*a* and 6*b* to one another, the wiring 200*b* for transmitting the output Gn+1_out from the last register 3*a* of the shift register 4*a* illustrated in FIG. 11 is provided partially in the outer circumferential portion of the display area 2 on the CF glass substrate 12. In the same manner, the wiring 200*c* for transmitting the output Gn+2_out from the last register 3*b* of the shift register 4*b* illustrated in FIG. 11 may be provided partially in the outer circumferential portion of the display area 2 on the CF glass substrate 12, or both the wiring 200*b* for transmitting the output Gn+1_out from the last register 3*a* of the shift register 4*a* and the wiring 200*c* for transmitting the output Gn+2_out from the last register 3*b* of the shift register 4*b* may be provided partially in the outer circumferential portion of the display area 2 on the CF glass substrate 12. Such configurations allows the detection of breakage of the CF glass substrate 12 in the area ranging from the outer circumference thereof to the display area 2, in the same manner as in the first and second embodiments.

As described above, the display device 100*b* according to the third embodiment includes the shift registers 4*a* and 4*b* and the control circuit 5*b* that supplies the clock pulse VCLK to each of the registers 3*a* and 3*b* included in the shift registers 4*a* and 4*b*, respectively, and that supplies the start pulse VST1 to the first register 3*a* of the shift register 4*a* to acquire the output from the last register 3*a* of the shift register 4*a*, and also supplies the start pulse VST2 to the first register 3*b* of the shift register 4*b* to acquire the output from the last register 3*b* of the shift register 4*b*. In the display device 100*b*, the display area 2 is provided in the area surrounded by the shift registers 4*a* and 4*b*, the control circuit 5*b*, and the wiring that couples the shift registers 4*a* and 4*b* and the control circuit 5*b* to one another. With this configuration, monitoring the output from the last registers 3*a* and 3*b* of the shift registers 4*a* and 4*b* enables the detection of breakage in the area of the substrate 1*b*, the area ranging from the outer circumference of the substrate 1*b* to the display area 2.

The substrate 1*b* includes the TFT substrate 11*b* and the CF glass substrate 12 placed so as to face the TFT substrate 11*b* with the liquid crystal layer interposed therebetween, and the TFT substrate 11*b* is provided thereon with the control circuit 5*b*, the scanning circuit 6*a* including the shift register 4*a*, and the scanning circuit 6*b* including the shift register 4*b*. In the configuration, the wiring for coupling the control circuit 5*b* and the scanning circuits 6*a* and 6*b* to one another are provided to the TFT substrate 11*b*. As a result, breakage of the TFT substrate 11*b* can be detected in the area ranging from the outer circumference thereof to the display area 2.

Furthermore, of the pieces of wiring for coupling the control circuit 5*b* and the scanning circuits 6*a* and 6*b* to one another, either one or both of the wiring 200*b* for transmitting the output Gn+1_out from the last register 3*a* of the shift register 4*a* and the wiring 200*c* for transmitting the output Gn+2_out from the last register 3*b* of the shift register 4*b* is/are provided partially in the outer circumferential portion of the display area 2 on the CF glass substrate 12, so that breakage of the CF glass substrate 12 can be detected in the area ranging from the outer circumference thereof to the display area 2.

According to the present embodiment, the display device 100*b* can be provided that is capable of easily and quickly detecting the breakage of the display panel without causing an increase in the size of the device.

Fourth Embodiment

Figure 17:
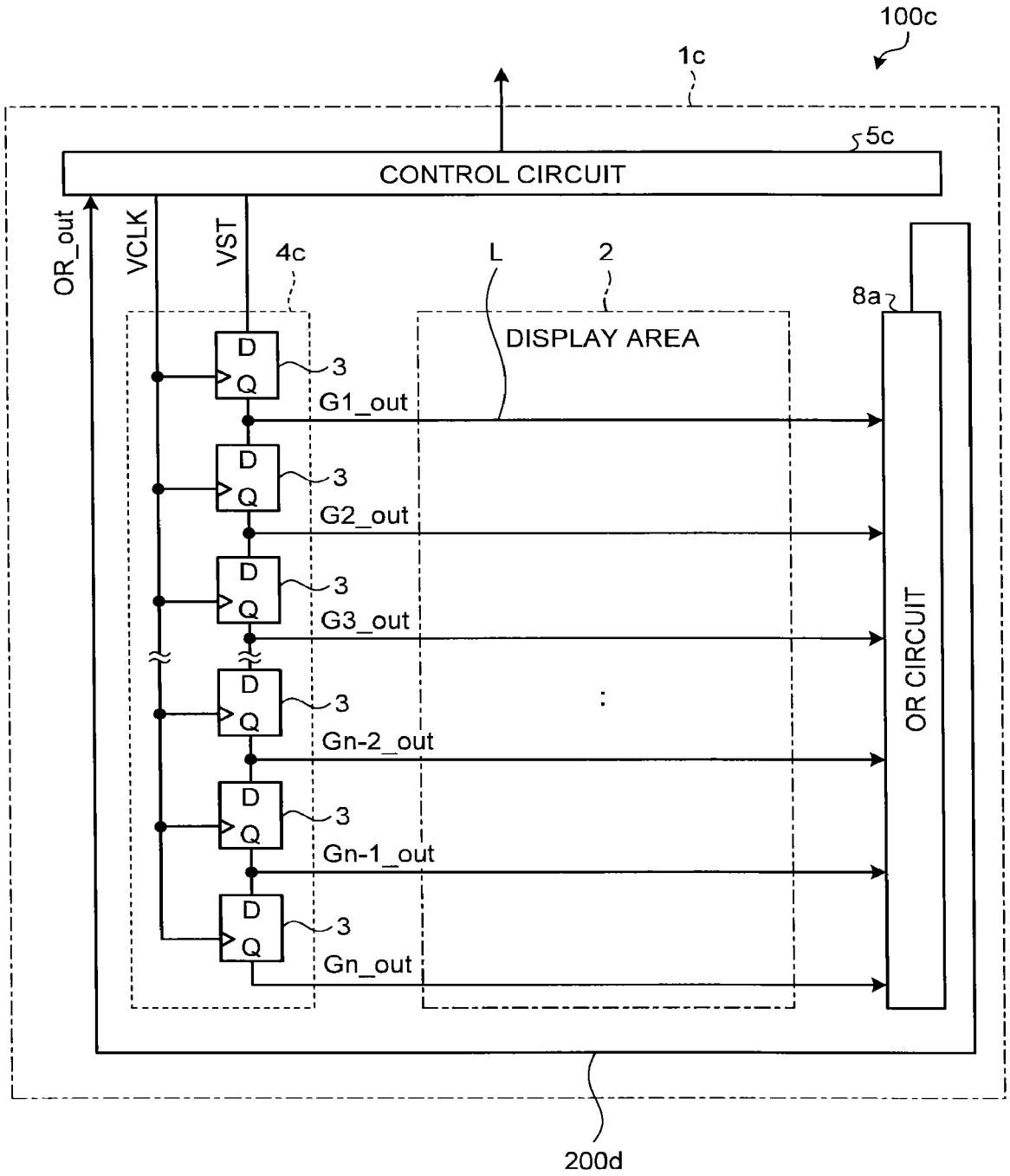
FIG. 17 is a diagram illustrating the schematic configuration of a display device according to a fourth embodiment.

FIG. 17 is a diagram illustrating the schematic configuration of a display device according to a fourth embodiment. The same components as those described in any of the embodiments described above are assigned with the same reference numerals, and the description thereof will not be repeated.

Unlike in the second embodiment described above, this display device 100*c* according to the present embodiment illustrated in FIG. 17 is configured such that the number of the registers 3 of a shift register 4*c* is equal to the number of pieces of the wiring L in the display area (n, in this case), and an OR circuit 8*a* outputs the logical sum OR_out of the outputs G1_out, G2_out, G3_out, Gn−2_out, Gn−1_out, and Gn_out of the n registers 3 that are supplied via the wiring L, to a control circuit 5*c*. In the present embodiment, the display area 2 is provided in an area surrounded by the shift register 4*c*, the control circuit 5*c*, the OR circuit 8*a*, and wiring that couples the shift register 4*c*, the control circuit 5*c*, and the OR circuit 8*a* to one another. Wiring 200*d* for transmitting the output OR_out of the OR circuit 8*a* is laid so as to separate the display area 2 from outer circumferential ends of a substrate 1*c*.

Based on the output OR_out of the OR circuit 8*a*, the control circuit 5*c* determines whether the substrate 1*c* has been broken. If a breakage of the substrate 1*c* has been detected, the control circuit 5*c* outputs an alert to the higher-level system control unit.

Figure 18:
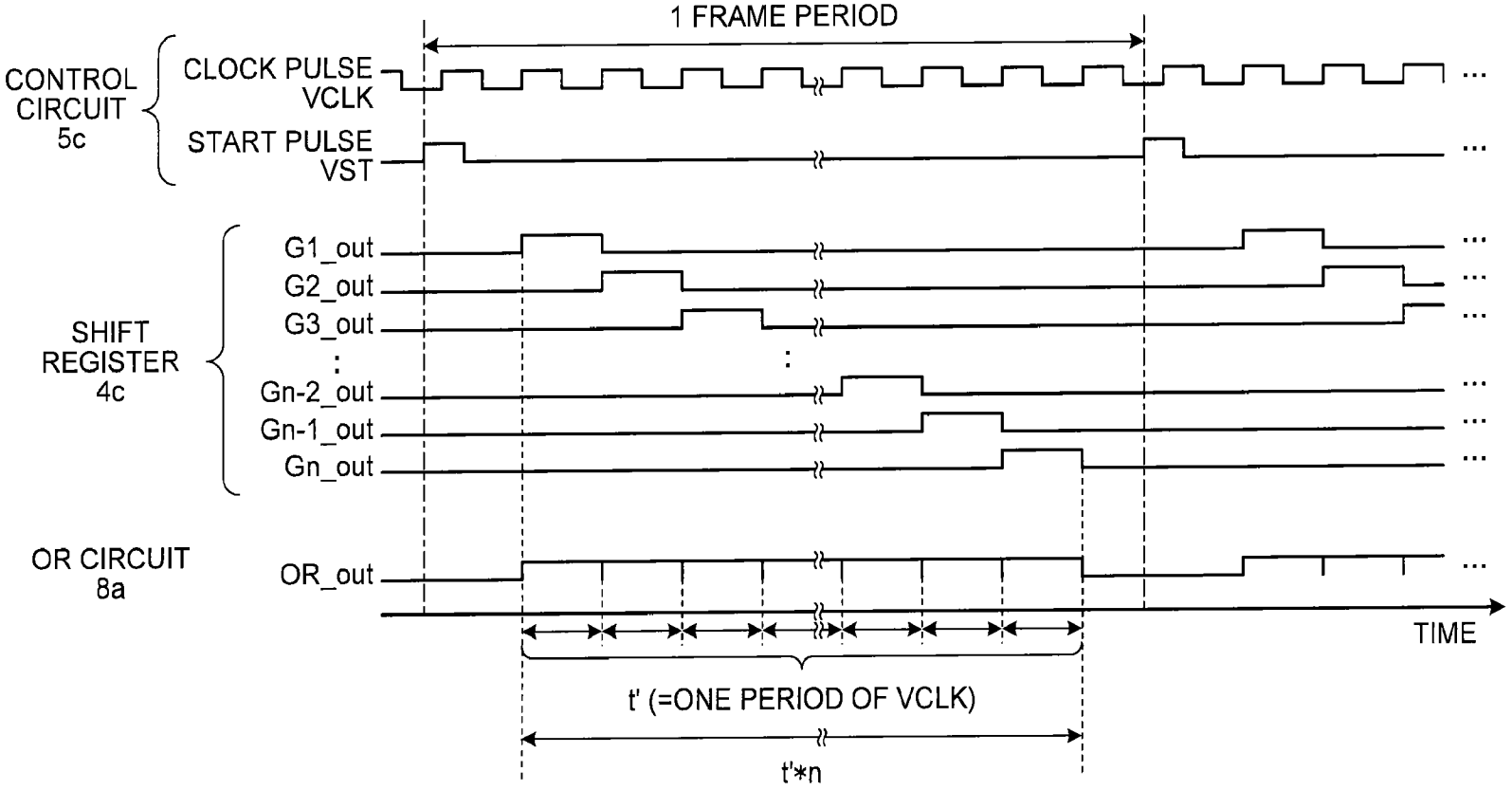
FIG. 18 is a diagram illustrating an example of a timing diagram of clock pulses, start pulses, outputs of registers included in a shift register, and outputs of an OR circuit in the display device according to the fourth embodiment.
Figure 19:
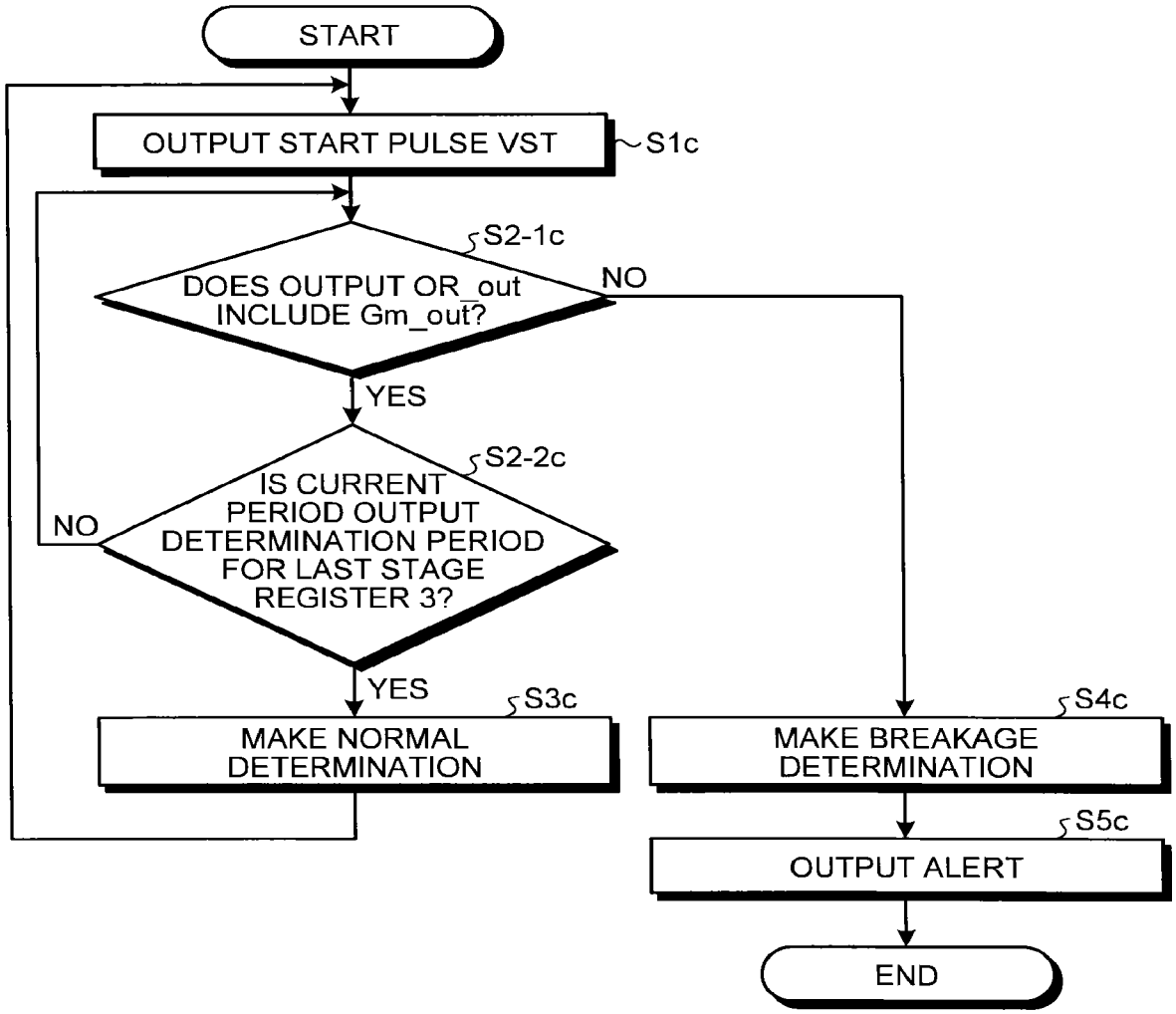
FIG. 19 is a diagram illustrating an example of a specific processing procedure in the display device according to the fourth embodiment.

The following describes a specific processing procedure in the display device 100*c* according to the fourth embodiment with reference to FIGS. 18 and 19. FIG. 18 is a diagram illustrating an example of a timing diagram of the clock pulses, the start pulses, the outputs of the registers included in the shift register, and the outputs of the OR circuit in the display device according to the fourth embodiment. FIG. 19 is a diagram illustrating an example of a specific processing procedure in the display device according to the fourth embodiment.

After the control circuit 5*c* outputs the start pulse VST (Step S1*c*), each of the registers 3 included in the shift register 4*c* sequentially outputs the output pulse Gm_out (where m is 1 to n) of the register 3 in synchronization with the clock pulse VCLK while shifting the output pulse Gm_out by up to the number of stages (n stages, in this case) of the registers 3.

At intervals of the breakage determination period t' (=one period of VCLK) for each of the registers 3 included in the shift register 4*c*, the control circuit 5*c* determines whether the output OR_out of the OR circuit 8*a* includes the output pulse Gm_out of the register 3 (Step S2-1*c*). If the output pulse Gm_out is output (Yes at Step S2-1*c*), the control circuit 5*c* subsequently determines whether the current period is the output determination period for the last register 3 (Step S2-2*c*). If not (No at Step S2-2*c*), the control circuit 5*c* returns the process to Step S2-1*c* to repeat the processing at Steps S2-1*c* and S2-2*c*. With this process, it can be determined whether each of all the registers 3 included in the shift register 4*c* has output the output pulse Gm_out during the whole breakage determination period t'*n.

If the current period is the output determination period for the last register 3 (Yes at Step S2-2*c*), the control circuit 5*c* makes the normal determination that no breakage of the substrate 1*c* has been detected (Step S3*c*), and returns the process to Step S1*c* to repeat the processing at Steps S1*c* to S2-2*c*.

If, at Step S2-1*c*, the output OR_out of the OR circuit 8*a* does not include the output pulse Gm_out of each of the registers 3 (No at Step S2-1*c*), the control circuit 5*c* determines that a breakage of the substrate 1*c* has been detected (Step S4*c*), and outputs an alert to the higher-level system control unit (Step S5*c*). Then, the process of this procedure ends.

As described above, in the present embodiment, the shift register 4*c*, the control circuit 5*c*, the OR circuit 8*a*, and the wiring for coupling the shift register 4*c*, the control circuit 5*c*, and the OR circuit 8*a* to one another are laid around the display area 2. As a result, the execution of the above-described processing procedure enables the detection of breakage of the shift register 4*c*, the control circuit 5*c*, or the OR circuit 8*a*, or the detection of disconnection in the wiring that couples together the shift register 4*c*, the control circuit 5*c*, and the OR circuit 8*a* and that include the wiring 200*d* for transmitting the output OR_out of the OR circuit 8*a*, and thus enables the detection of breakage in an area of the substrate 1*c* in the display device 100*c*, the area ranging from the outer circumference of the substrate 1*c* to the display area 2. The present embodiment is configured such that the logical sum OR_out of outputs G1_out, G2_out, G3_out, . . . , Gn−2_out, Gn−1_out, and Gn_out of the n registers 3 that are supplied via the wiring L in the display area 2 is output to the control circuit 5*c*. As a result, the breakage in the display area 2 can be detected at an earlier time and detected as a more specific position.

Figure 20:
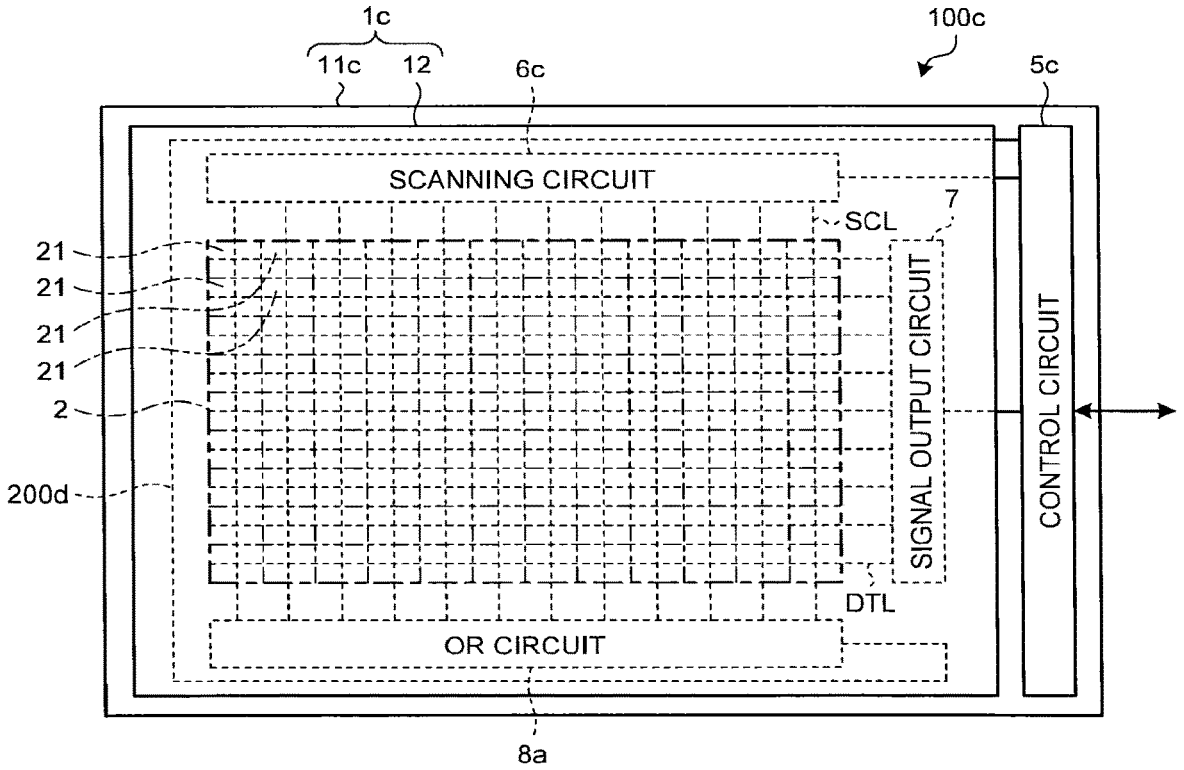
FIG. 20 is a diagram illustrating an example of a specific configuration example of the display device according to the fourth embodiment.

FIG. 20 is a diagram illustrating an example of a specific configuration example of the display device according to the fourth embodiment. In the example illustrated in FIG. 20, the display device 100*c* exemplifies a liquid crystal display device in which the substrate 1*c* includes a TFT substrate 11*c* and the CF glass substrate 12 placed so as to face the TFT substrate 11*c* with a liquid crystal layer interposed therebetween.

In the display device 100*c* illustrated in FIG. 20, the OR circuit 8*a* is provided to the TFT substrate 11*c* in the same manner as the scanning circuit 6*c* and the signal output circuit 7.

In the same manner as in the first to third embodiments, the control circuit 5*c* has, in addition to the function to output an alert in the event of detection of the breakage of the substrate 1*c*, a function to control the scanning circuit 6*c* and the signal output circuit 7 based on the externally received image data.

The example illustrated in FIG. 20 illustrates an example in which the wiring for coupling together the control circuit 5*c*, the scanning circuit 6*c*, and the OR circuit 8*a* are provided to the TFT substrate 11*c*, that is to say, the wiring illustrated in FIG. 17 including wiring for transmitting the clock pulse VCLK, wiring for transmitting the start pulse VST, and the wiring 200*d* for transmitting the output OR_out of the OR circuit 8*a* are provided to the TFT substrate 11*c*. With this configuration, a breakage in an area including the display area 2 on the TFT substrate 11*c* can be detected, and the breakage in the display area 2 on the TFT substrate 11*c* can be detected at an earlier time and detected as a more specific position.

Figure 21:
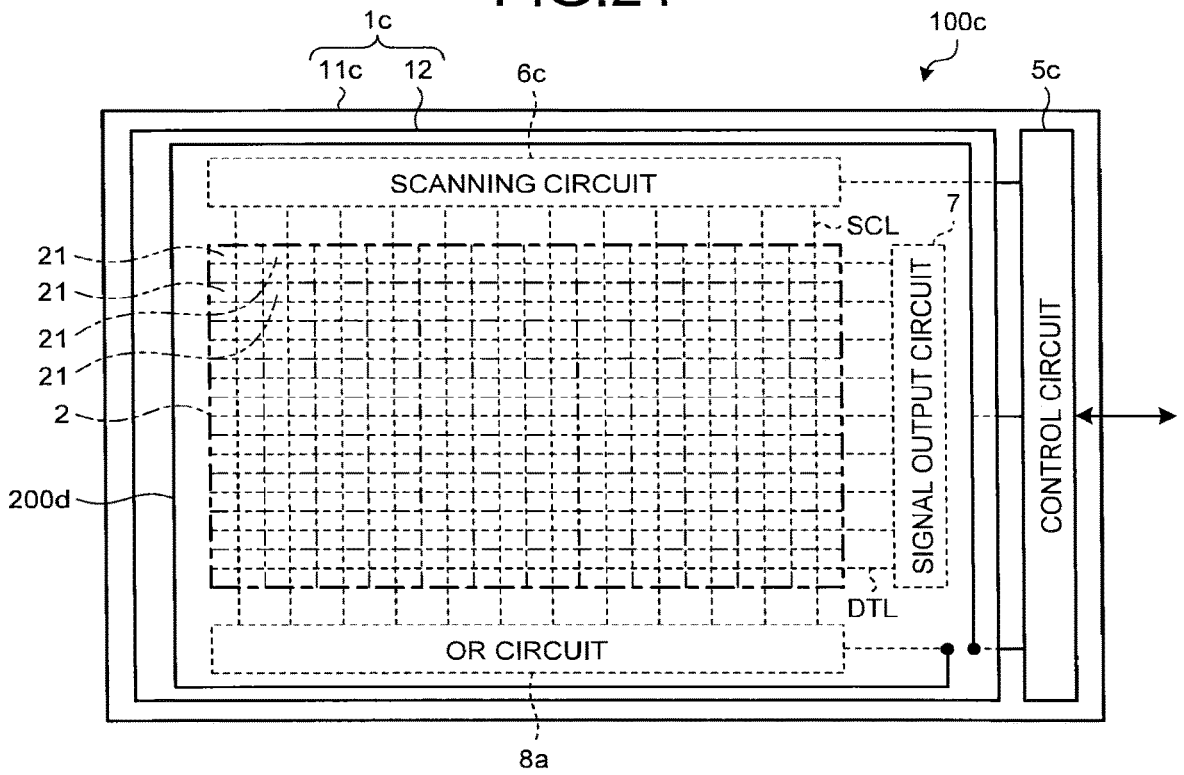
FIG. 21 is a diagram illustrating a modification of the specific configuration example of the display device according to the fourth embodiment.

FIG. 21 is a diagram illustrating a modification of the specific configuration example of the display device according to the fourth embodiment. FIG. 21 illustrates an example in which, of the pieces of wiring for coupling together the control circuit 5*c*, the scanning circuit 6*c*, and the OR circuit 8*a*, the wiring 200*d* for transmitting the output OR_out of the OR circuit 8*a* illustrated in FIG. 17 is provided partially in the outer circumferential portion of the display area 2 on the CF glass substrate 12. With this configuration, the breakage in the display area 2 on the CF glass substrate 12 can also be detected.

As described above, unlike in the second embodiment described above, the display device 100*c* according to the fourth embodiment is configured such that the number of the registers 3 of a shift register 4*c* is equal to the number of pieces of the wiring L in the display area (n, in this case), and the OR circuit 8*a* outputs the logical sum OR_out of the outputs G1_out, G2_out, G3_out, . . . , Gn−2_out, Gn−1_out, and Gn_out of the n registers 3 that are supplied via the wiring L, to the control circuit 5*c*. The display area 2 is provided in an area surrounded by the shift register 4*c*, the control circuit 5*c*, the OR circuit 8*a*, and wiring that couples the shift register 4*c*, the control circuit 5*c*, and the OR circuit 8*a* to one another. With this configuration, monitoring the output of the output OR_out from the OR circuit 8*a* enables the detection of breakage in the area of the substrate 1*c* in the display device 100*c*, the area ranging from the outer circumference of the substrate 1*c* to the display area 2. The display device 100*c* is configured such that the logical sum OR_out of the outputs G1_out, G2_out, G3_out, . . . , Gn−2_out, Gn−1_out, and Gn_out of the n registers 3 that are supplied via the wiring L in the display area 2 is output to the control circuit 5*c*. As a result, the breakage in the display area 2 can be detected at an earlier time and detected as a more specific position.

The substrate 1*c* includes the TFT substrate 11*c* and the CF glass substrate 12 placed so as to face the TFT substrate 11*c* with the liquid crystal layer interposed therebetween, and the TFT substrate 11*c* is provided thereon with the control circuit 5*c*, the scanning circuit 6*c* including the shift register 4*c*, and the OR circuit 8*a*. In the configuration, the wiring for coupling the control circuit 5*c*, the scanning circuit 6*c*, and the OR circuit 8*a* to one another are provided to the TFT substrate 11*c*. As a result, a breakage of the TFT substrate 11*c* can be detected in the area ranging from the outer circumference thereof to the display area 2. As a result, a breakage of the TFT substrate 11*c* can be detected in the area ranging from the outer circumference thereof to the display area 2. The display device 100*c* is configured such that the logical sum OR_out of the outputs G1_out, G2_out, G3_out, . . . , Gn−2_out, Gn−1_out, and Gn_out of the n registers 3 that are supplied via the wiring L in the display area 2 is output to the control circuit 5*c*. As a result, the breakage in the display area 2 on the TFT substrate 11*c* can be detected at an earlier time and detected as a more specific position.

Furthermore, of the pieces of wiring for coupling the control circuit 5*c*, the scanning circuit 6*c*, and the OR circuit 8*a* to one another, the wiring 200*d* for transmitting the output OR_out of the OR circuit 8*a* is provided partially in the outer circumferential portion of the display area 2 on the CF glass substrate 12, so that a breakage of the CF glass substrate 12 can also be detected in the area ranging from the outer circumference thereof to the display area 2.

According to the present embodiment, the display device 100*c* can be provided that is capable of easily and quickly detecting the breakage of the display panel without causing an increase in the size of the device.

In the example described above, the wiring 200*d* for transmitting the output OR_out of the OR circuit 8*a* is laid so as to separate the display area 2 from the outer circumferential ends of the substrate 1*c*. The display device 100*c* is, however, configured such that the logical sum OR_out of the outputs G1_out, G2_out, G3_out, . . . , Gn−2_out, Gn−1_out, and Gn_out of the n registers 3 that are supplied via the wiring L in the display area 2 is output to the control circuit 5*c*. As a result, a breakage in the display area 2 can be detected even if the wiring 200*d* for transmitting the output OR_out of the OR circuit 8*a* were not laid so as to separate the display area 2 from the outer circumferential ends of the substrate 1*c*. Such a configuration is conceivable in which the OR circuit 8*a* and the control circuit 5*c* are arranged in the periphery of the display area 2, and wiring is laid in an area between these circuits to couple the OR circuit 8*a* to the control circuit 5*c*. In this case, the wiring can be laid without being routed around the outer circumference of the display area 2. As an example of such a layout, a configuration is conceivable in which the wiring is provided between the closest areas, or the adjacent areas, of the OR circuit 8*a* and the control circuit 5*c*.

Figure 22:
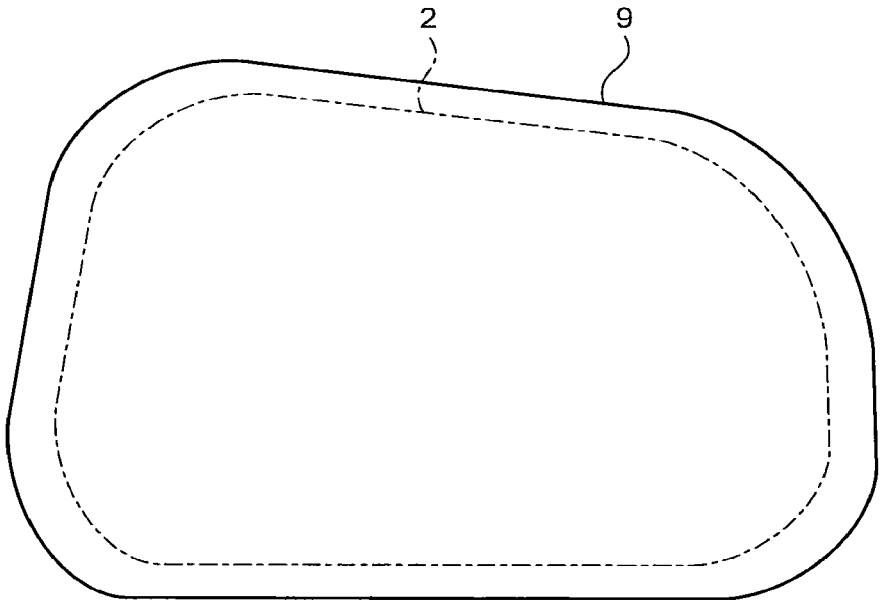
FIG. 22 is a view illustrating an application example of the display device according to any of the embodiments.

FIG. 22 is a view illustrating an application example of the display device according to any of the embodiments. FIG. 22 illustrates an example in which any one of the display devices 100, 100*a*, 100*h*, and 100*c* according to the embodiments is used instead of a conventional side view mirror of an automobile.

As illustrated in FIG. 22, when the display device 100, 100*a*, 100*b*, or 100*c* according to the corresponding embodiment is used as a side view mirror 9 of the automobile, the display area 2 of the display device 100, 100*a*, 100*b*, or 100*c* according to the corresponding embodiment is conceivable to have a special non-rectangular shape, as illustrated in FIG. 22.

Each of the display devices 100, 100*a*, 100*b*, and 100*c* according to the embodiments described above can be used not only as an in-vehicle display device, but also as, for example, a display device for a smartphone or the like, and moreover, can naturally have various shapes, such as a circular shape and an oval shape, in addition to the above-mentioned special shape illustrated in FIG. 22.

The present invention is not limited to the description of the embodiments set forth above. The components of the present invention described above include a component or components that is/are easily conceivable by those skilled in the art, substantially the same component or components, and what is/are called an equivalent or equivalents. Moreover, the components described above can be appropriately combined. The components can be variously omitted, replaced, and modified without departing from the gist of the present invention.

What is claimed is:

1. A display device comprising:

a display area provided to a substrate;

a plurality of pixels arranged in a matrix having n pixel columns (where n is a natural number) in the display area;

a first shift register including n/2 registers and coupling portions between the registers, each of the coupling portions being coupled to one end of a scanning lines arranged in the display area, and further including a first last register;

a second shift register including n/2 registers and coupling portions between the registers, each of the coupling portions being coupled to one end of a scanning lines arranged in the display area, and further including a second last register; and a first wiring coupled to the first last register;

a second wiring coupled to the second last register; and a control circuit that supplies clock pulses to the first last and second last registers, and that supplies a start pulse to a first register of each of the first shift register and the second shift register and acquires an output from the first last and second last registers via the first and second wirings, wherein the display area is provided in an area surrounded by the first and second shift registers, the control circuit, and the first wiring and the second wiring, the first wiring and second wiring extend along a circumference of the display area respectively from the first last register and the second last register to the control circuit such that a combination of (i) the control circuit, (ii) a path of the clock pulses from the control circuit to each of the first shift register and the second shift register, (iii) the first shift register and the second shift register, and (iv) the first wiring and second wiring extending from the first last register and the second last register to the control circuit completely encloses the display area, the control circuit is arranged in a vicinity of one side of the display area and at least parts of the first wiring and second wiring are arranged along another one side of the display area opposite to the one side, and the first wiring and second wiring are overlapped with each other, and any signals output from the first and second last registers are provided to the first and second wirings, and do not pass through the display area, wherein the first wiring and the second wiring respectively extend along the circumference of the display area such that a breakage of the substrate within an area circumscribed by the first wiring and the second wiring will prevent the control circuit from receiving a signal from at least one of the first last register and the second last register to send a signal, wherein the signal would be received by the control circuit if the substrate was not broken within the area circumscribed by the first wiring and the second wiring.

2. The display device according to claim 1, wherein each of the coupling portions is coupled to one end of corresponding one of n scanning lines provided in the display area so as to correspond to n pixel columns, each of the n pixel columns including pixels arranged in-line.

3. The display device according to claim 2, wherein the control circuit determines whether the substrate has been broken, based on the output from the last register of each of the first shift register and the second shift register.

4. The display device according to claim 2, wherein an output end of the last register is coupled to the other ends of the scanning lines via an OR circuit, and an output of the OR circuit is supplied to the control circuit.

5. The display device according to claim 4, wherein the control circuit determines whether the substrate has been broken, based on the output from the OR circuit.

6. The display device according to claim 1, wherein the control circuit determines whether the substrate has been broken, based on the output from at least one of the first last register or the second last register.

7. The display device according to claim 1, wherein the control circuit determines whether the substrate has been broken, based on the output from at least one of the first last register or the second last register.

8. The display device according to claim 1, wherein the substrate comprises:

a TFT substrate provided with the first shift register, the second shift register, and the control circuit; and a CF glass substrate placed so as to face the TFT substrate with a liquid crystal layer interposed between the CF glass substrate and the TFT substrate.

9. The display device according to claim 8, wherein the first and second wirings are provided to the TFT substrate.

10. The display device according to claim 9, wherein the first and second wirings are provided partially in an outer circumferential portion of the display area on the CF glass substrate.

11. The display device according to claim 8, wherein the first and second wirings are provided partially in an outer circumferential portion of the display area on the CF glass substrate.

12. The display device according to claim 1, wherein the control circuit is configured to signal that the substrate is broken when the control circuit does not receive both a first signal from the first last register and a second signal from second last register, and does not signal that the substrate is broken when the control circuit receives the first signal from the first last register and receives the second signal from the second last register.

* * * * *